US008025389B2

(12) United States Patent
Yamanobe et al.

(10) Patent No.: US 8,025,389 B2
(45) Date of Patent: Sep. 27, 2011

(54) IMAGE FORMING APPARATUS AND IMAGE FORMING METHOD

(75) Inventors: Jun Yamanobe, Kanagawa-ken (JP); Toshiyuki Makuta, Kanagawa-ken (JP); Yuhei Chiwata, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 461 days.

(21) Appl. No.: 12/236,935

(22) Filed: Sep. 24, 2008

(65) Prior Publication Data

US 2009/0080949 A1 Mar. 26, 2009

(30) Foreign Application Priority Data

Sep. 25, 2007 (JP) ..... 2007-247973

(51) Int. Cl.
*B41J 2/01* (2006.01)

(52) U.S. Cl. ..... 347/103; 347/101

(58) Field of Classification Search ..... 347/101, 347/103, 104, 99, 88
See application file for complete search history.

(56) References Cited

U.S. PATENT DOCUMENTS 6,386,697 B1 5/2002 Yamamoto et al.
6,422,696 B1 7/2002 Takahashi et al.
2003/0068571 A1 * 4/2003 Uehara et al. ..... 347/101

FOREIGN PATENT DOCUMENTS

EP 1 733 898 A2 12/2006
JP 2002-370442 A 12/2002

* cited by examiner

*Primary Examiner* — Manish S Shah
(74) *Attorney, Agent, or Firm* — Birch, Stewart, Kolasch & Birch, LLP.

(57) ABSTRACT

An image forming apparatus which forms a primary image on an intermediate transfer body and then transfers the primary image onto a recording medium, has: a movement device which moves the intermediate transfer body in a movement direction; a recess-projection forming device which forms a recess-projection shape in an image forming surface of the intermediate transfer body; a droplet ejection device which is provided on a downstream side of the recess-projection forming device in terms of the movement direction and ejects droplets of ink onto the image forming surface of the intermediate transfer body in which the recess-projection shape has been formed, to form the primary image; and a transfer recording device which is provided on a downstream side of the droplet ejection device in terms of the movement direction and applies pressure to at least one of the intermediate transfer body and the recording medium in a state where the recording medium makes contact with the primary image formed on the image forming surface of the intermediate transfer body to transfer the primary image onto the recording medium.

26 Claims, 12 Drawing Sheets

FIG.9A

| | |
|---|---|
| STYRENE ACRYL RESIN LIQUID (JONCRYL 537 MADE BY JOHNSON POLYMER, INC.) | 50 PARTS BY WEIGHT |
| PHOSPHORIC ACID | 10 PARTS BY WEIGHT |
| OLEFIN | 1.5 PARTS BY WEIGHT |
| ION-EXCHANGE WATER | REMAINDER |

FIG.9B

| | |
|---|---|
| PIGMENT | 5 PARTS BY WEIGHT |
| GLYCERINE | 20 PARTS BY WEIGHT |
| DIETHYLENE GLYCOL | 10 PARTS BY WEIGHT |
| OLEFIN | 1 PART BY WEIGHT |
| ION-EXCHANGE WATER | REMAINDER |

FIG.10A

| | |
|---|---|
| NO RECESS-PROJECTION IMPRESSIONS PRESENT (Ra=0.2 μm) | NOT GOOD<br>MARKED SHRINKAGE OF SOLID IMAGE REGION WITH RESPECT TO DESIRED DROPLET EJECTION REGION<br>BENDING OF LINE IMAGES |
| RECESS-PROJECTION IMPRESSIONS PRESENT (Ra=1.2 μm) | GOOD<br>GOOD IMAGE COULD BE FORMED |

FIG.10B

| | |
|---|---|
| TRANSFER TEMPERATURE 90° C (Ra=0.5 μm) | GOOD<br>GOOD TRANSFER WAS ACHIEVED |
| TRANSFER TEMPERATURE 50° C (Ra=1.2 μm) | NOT GOOD<br>PARTIAL SPOTTING INSIDE DOTS |

IMAGE FORMING APPARATUS AND IMAGE FORMING METHOD

BACKGROUND OF THE INVENTION

1. Field of the Invention

The present invention relates to an image forming apparatus and image forming method, and for example, to image forming technology for forming dots by causing ink droplets to react with treatment liquid on an image forming body.

2. Description of the Related Art

At present, an inkjet recording apparatus is used favorably as a generic image forming apparatus which outputs images captured by a digital camera or duplicates images of a printed object, or the like. An inkjet recording apparatus can use paper and other various types of recording medium such as a resin sheet, a metal sheet and the like, and the most recent tendency is to be increasing demands for the output of high-quality images, regardless of the type of recording medium.

However, there are problems in relation to print quality in that the print state varies with the paper quality, namely, with the type of the recording medium, for example, whether the medium is an OHP sheet, synthetic paper, normal paper, special inkjet paper, or the like. In particular, when printing onto normal paper using a water-soluble ink which has generic versatility, there are problems in terms of reduction in the printing resolution due to bleeding or print-through during printing, in addition to which, depending on the drying properties of the ink on the recording medium after printing, a printed image which is an undried state when the recording medium is output may be disturbed. In order to eliminate problems of this kind, a transfer recording method has been proposed in which a primary image is formed on an intermediate transfer body and the primary image is then transferred and recorded onto a recording medium.

In a transfer recording method, if the intermediate transfer body has little surface roughness, then a water repellency effect is liable to occur, whereas if the intermediate transfer body has a large surface roughness, then the transfer properties become poor, and furthermore, ink enters into the recess sections and the ink becomes smudged. Consequently, technology for forming a desirable primary image on the intermediate transfer body, and technology for improving the transfer properties when the primary image is transferred to the recording medium, have been proposed.

Japanese Patent Application Publication No. 2002-370442 describes an inkjet recording method and an image forming method which prevent a water repellency effect by providing a surface roughness of a suitable range (500 to 12000 projections with a height of 1 to 10 μm per $mm^2$) on the surface of the intermediate transfer body.

However, if the intermediate transfer body has a high flatness, then deformation of the primary image formed on the intermediate transfer body may occur. In particular, in a two-liquid method which aggregates ink by reaction between the ink and a treatment liquid, or in a method which dries the solvent forcibly by heating, the deformation of the primary image is especially marked. On the other hand, if the surface of the intermediate transfer body is rough, then the transfer properties are poor. Furthermore, if the surface roughness of the recording medium changes, then the transfer rate (transfer properties) also varies. If a recording medium having large surface roughness, such as recycled paper, is used, then the contact surface area between the intermediate transfer body and the recording medium becomes lower and the transfer rate declines. In other words, it is extremely difficult maintain good quality in the primary image at the same time as achieving good transfer properties, and furthermore it is extremely difficult to ensure good quality of the recorded image in respect of a large number of different types of recording media.

It is an object of the invention described in Japanese Patent Application Publication No. 2002-370442 to restrict bleeding and color mixing in an ink image formed on a transfer medium (intermediate transfer body), as well as preventing water repellency effects. On the other hand, although this patent reference does mention that transfer properties deteriorate if the surface of the transfer medium is rough, concrete technology for improving the transfer properties is not disclosed. Neither is there any description of the type of recording medium or temporal change in the intermediate transfer body. In other words, the invention described in Japanese Patent Application Publication No. 2002-370442 has difficulty in responding to recording media of various types, and also has difficulty in responding to temporal change in the intermediate transfer body.

SUMMARY OF THE INVENTION

The present invention has been contrived in view of these circumstances, an object thereof being to provide an image forming apparatus and an image forming method whereby high quality of a primary image formed on an intermediate transfer body in a transfer recording system can be ensured at the same time as ensuring certain transfer properties, a desirable recording image can be obtained on any recording medium, and furthermore, decline in the quality of the recorded images due to temporal change in the intermediate transfer body can be prevented.

In order to attain an object described above, one aspect of the present invention is directed to an image forming apparatus which forms a primary image on an intermediate transfer body and then transfers the primary image onto a recording medium, the image forming apparatus comprising: a movement device which moves the intermediate transfer body in a movement direction; a recess-projection forming device which forms a recess-projection shape in an image forming surface of the intermediate transfer body; a droplet ejection device which is provided on a downstream side of the recess-projection forming device in terms of the movement direction and ejects droplets of ink onto the image forming surface of the intermediate transfer body in which the recess-projection shape has been formed, to form the primary image; and a transfer recording device which is provided on a downstream side of the droplet ejection device in terms of the movement direction and applies pressure to at least one of the intermediate transfer body and the recording medium in a state where the recording medium makes contact with the primary image formed on the image forming surface of the intermediate transfer body to transfer the primary image onto the recording medium.

According to this aspect of the invention, since a recess-projection shape is formed in the intermediate transfer body before the ejection of ink droplets, and the recess-projection shape of the intermediate transfer body is crushed and flattened during transfer and recording, then the flow of ink on the intermediate transfer body during formation of the primary image is prevented, a sufficient contact surface area between the intermediate transfer body and the recording medium can be ensured during the transfer recording operation, and it is possible to achieve desirable image recording of high quality, regardless of the type of recording medium.

Furthermore, since the recess-projection shape is formed in the intermediate transfer body at each image recording operation, then even if there is temporal change in the intermediate transfer body, a uniform recess-projection shape is formed at all times.

A desirable mode is one where a cleaning treatment device is provided for carrying out a cleaning process of the intermediate transfer body after the transfer recording operation.

Desirably, the image forming apparatus further comprises an application device which is provided on an upstream side of the recess-projection forming device in terms of the movement direction and applies resin material onto the image forming surface of the intermediate transfer body, wherein the recess-projection forming device includes a pressing member with a surface having a recess-projection shape corresponding to the recess-projection shape to be formed in the image forming surface of the intermediate transfer body, the pressing member being pressed against the resin material on the intermediate transfer body to form the recess-projection shape in the image forming surface of the intermediate transfer body.

According to this aspect of the invention, a resin material is desirable since it is excellent in terms of the ease of forming a recess-projection shape, and also allows the recess-projection shape to be crushed readily.

The resin material may be a resin liquid (a liquid formed by dissolving or dispersing resin material in a solvent), or it may be a solid or a semi-solid material. From the viewpoint of applicability, a desirable mode is one which uses a resin liquid obtained by dissolving a resin material in a solvent or a resin liquid obtained by dispersing resin micro-particles in a solvent.

In a mode which uses a resin liquid, it is desirable to provide a drying treatment device which dries (cures) the resin liquid before forming the recess-projection shape.

Desirably, the image forming apparatus further comprising a resin material heating device which heats the resin material on the image forming surface of the intermediate transfer body, wherein: the resin material to be applied onto the image forming surface of the intermediate transfer body by the application device contains a thermoplastic resin material; and the resin material heating device heats the resin material in such a manner that the thermoplastic resin material assumes a softened state while the recess-projection forming device forms the recess-projection shape.

According to this aspect of the invention, a thermoplastic material is desirable since by imparting heat to same, the ease of forming the recess-projection shape is improved. A state in which the thermoplastic resin material is softened includes a state where the thermoplastic material has been heated to the glass transition temperature or the melting point.

Desirably, the resin material heating device is provided between the application device and the recess-projection forming device.

According to this aspect of the invention, by heating the thermoplastic resin material before forming recess-projection impressions, it is easy to form the recess-projection shape by the recess-projection forming unit. Furthermore, by previously heating the thermoplastic resin material before forming the recess-projection shape, it is not necessary to carry out sudden heating, and therefore the application of excessive thermal stress to the intermediate transfer body and the adjacent composition can be prevented.

Desirably, the resin material heating device is provided at a position across the intermediate transfer body from the recess-projection forming device to correspond to a position of the recess-projection forming device.

According to this aspect of the invention, by heating the thermoplastic resin material during recess-projection forming by the recess-projection forming unit, it is easy to form the recess-projection shape by the recess-projection forming unit. Furthermore, it is also possible to restrict the heating of the thermoplastic resin material to the minimum necessary level.

Desirably, the resin material heating device is incorporated into the intermediate transfer body.

According to this aspect of the invention, it is possible to heat the thermoplastic resin material on the intermediate transfer body without providing a heater in the periphery of the intermediate transfer body, and therefore a contribution is made to simplifying the composition of the apparatus. The resin material heating device may also serve as a drying treatment device which dries the resin liquid.

Desirably, the image forming apparatus further comprises a treatment liquid application device which applies a treatment liquid which enhances aggregation of the ink or increases in viscosity of the ink, onto the image forming surface of the intermediate transfer body.

It is possible to use a roller or blade, or an inkjet method (inkjet head), for the treatment liquid application device.

Desirably, the application device also serves as the treatment liquid application device, and applies the treatment liquid and the resin material onto the image forming surface of the intermediate transfer body.

In this aspect of the invention, by using the same device to serve as the application device which applies resin material and the treatment liquid application device, the composition of the apparatus is simplified and the image forming step is also simplified.

Desirably, the intermediate transfer body has, in the image forming surface, a surface layer in which the recess-projection forming device forms the recess-projection shape; and the recess-projection forming device includes a pressing member with a surface having a recess-projection shape corresponding to the recess-projection shape to be formed in the image forming surface of the intermediate transfer body, the pressing member being pressed against the surface layer of the intermediate transfer body to form the recess-projection shape in the image forming surface of the intermediate transfer body.

In this aspect of the invention, by using the surface layer repeatedly, it is possible to omit the application device which applies resin material to the intermediate transfer body as described above, and the composition of the apparatus is simplified. Furthermore, used resin material is not generated each time an image is formed, and the maintenance load is reduced.

Desirably, the image forming apparatus further comprises a surface layer heating device which heats the surface layer of the image forming surface of the intermediate transfer body while the recess-projection forming device forms the recess-projection shape in the image forming surface.

In this aspect of the invention, it is possible to form a recess-projection shape in the surface layer efficiently by heating the surface layer during formation of the recess-projection impressions, and it is also possible to restrict the heating of the surface layer to the minimum necessary level.

Desirably, the image forming apparatus further comprises: a determination device which determines a state of the surface layer of the image forming surface of the intermediate transfer body; and a transfer heating device that is provided on a downstream side of the droplet ejection device in terms of the movement direction and heats the intermediate transfer body on which the primary image has been formed, wherein the recess-projection forming device forms the recess-projection shape in the image forming surface in such a manner that, if an amount of recess-projection of the surface layer determined by the determination device is greater than a reference amount of recess-projection, then the pressing member is pressed against the surface layer with a pressure smaller than a reference value or the transfer heating device less heats the intermediate transfer body than a reference value.

In this aspect of the invention, since the parameters used during recess-projection formation are controlled in accordance with the surface properties of the surface layer, it is possible to form a uniform recess-projection shape at all times.

Desirably, the image forming apparatus further comprises a determination device which determines a state of the surface layer of the image forming surface of the intermediate transfer body, wherein: the recess-projection forming device has a plurality of recess-projection forming members which are formed with recess-projection impressions of different shapes; and the recess-projection forming device switches selectively among the plurality of recess-projection forming members in accordance with an amount of recess-projection of the surface layer determined by the determination device.

The plurality of recess-projection shape forming members having different shapes may have different recess-projection patterns, and different recess-projection cycles and/or amplitudes.

A desirable mode is one which comprises a solvent removal device which removes solvent on the intermediate transfer body, provided to the downstream side of the droplet ejection device in terms of the prescribed movement direction.

Desirably, the image forming apparatus further comprises a treatment liquid application device applying a treatment liquid which reacts with the ink to enhance aggregation of the ink or increase in viscosity of the ink, onto the image forming surface of the intermediate transfer body.

Desirably, the image forming apparatus comprises a transfer heating device that is provided on a downstream side of the droplet ejection device in terms of the movement direction and heats the intermediate transfer body on which the primary image has been formed, wherein the transfer recording device transfers the primary image formed on the intermediate transfer body onto the recording medium, and flattens the recess-projection shape.

In this aspect of the invention, it is possible to flatten the intermediate transfer body efficiently, by applying both pressure and heat.

In order to attain an object described above, another aspect of the present invention is directed to an image forming method of forming a primary image on an intermediate transfer body and then transferring the primary image onto a recording medium, the image forming method comprising: a movement step of moving the intermediate transfer body in a movement direction; a recess-projection forming step of forming a recess-projection shape in an image forming surface of the intermediate transfer body; a droplet ejection step of ejecting droplets of ink onto the image forming surface of the intermediate transfer body in which the recess-projection shape has been formed after the recess-projection forming step to form the primary image on the intermediate transfer body; and a transfer recording step of applying pressure to at least one of the intermediate transfer body and the recording medium in a state where the recording medium makes contact with the primary image formed on the image forming surface of the intermediate transfer body after the droplet ejection step, to transfer the primary image onto the recording medium.

A desirable mode is one which includes an intermediate transfer body heating step which heats the intermediate transfer body before the recess-projection forming step or during the recess-projection forming step. Furthermore, a desirable mode is one where a cleaning treatment step is provided for carrying out a cleaning process of the intermediate transfer body after the transfer recording operation.

According to the present invention, since a recess-projection shape is formed in the intermediate transfer body before the ejection of ink droplets, and the recess-projection shape of the intermediate transfer body is crushed and flattened during transfer and recording, then the flow of ink on the intermediate transfer body during formation of the primary image is prevented, a sufficient contact surface area between the intermediate transfer body and the recording medium can be ensured during the transfer recording operation, and it is possible to achieve desirable image recording of high quality, regardless of the type of recording medium. Furthermore, since the recess-projection shape is formed in the intermediate transfer body at each image recording operation, then even if there is temporal change in the intermediate transfer body, a uniform recess-projection shape is formed at all times.

BRIEF DESCRIPTION OF THE DRAWINGS

The nature of this invention, as well as other objects and benefits thereof will be explained in the following with reference to the accompanying drawings, in which like reference characters designate the same or similar parts throughout the figures and wherein:

FIGS. 9A and 9B show an example of the composition of the resin liquid and ink used in the inkjet recording apparatus illustrated in FIG. 1;

FIGS. 10A and 10B are diagrams which describe the results of an evaluation experiment;

DETAILED DESCRIPTION OF THE PREFERRED EMBODIMENTS

Composition of Apparatus

Figure 1:
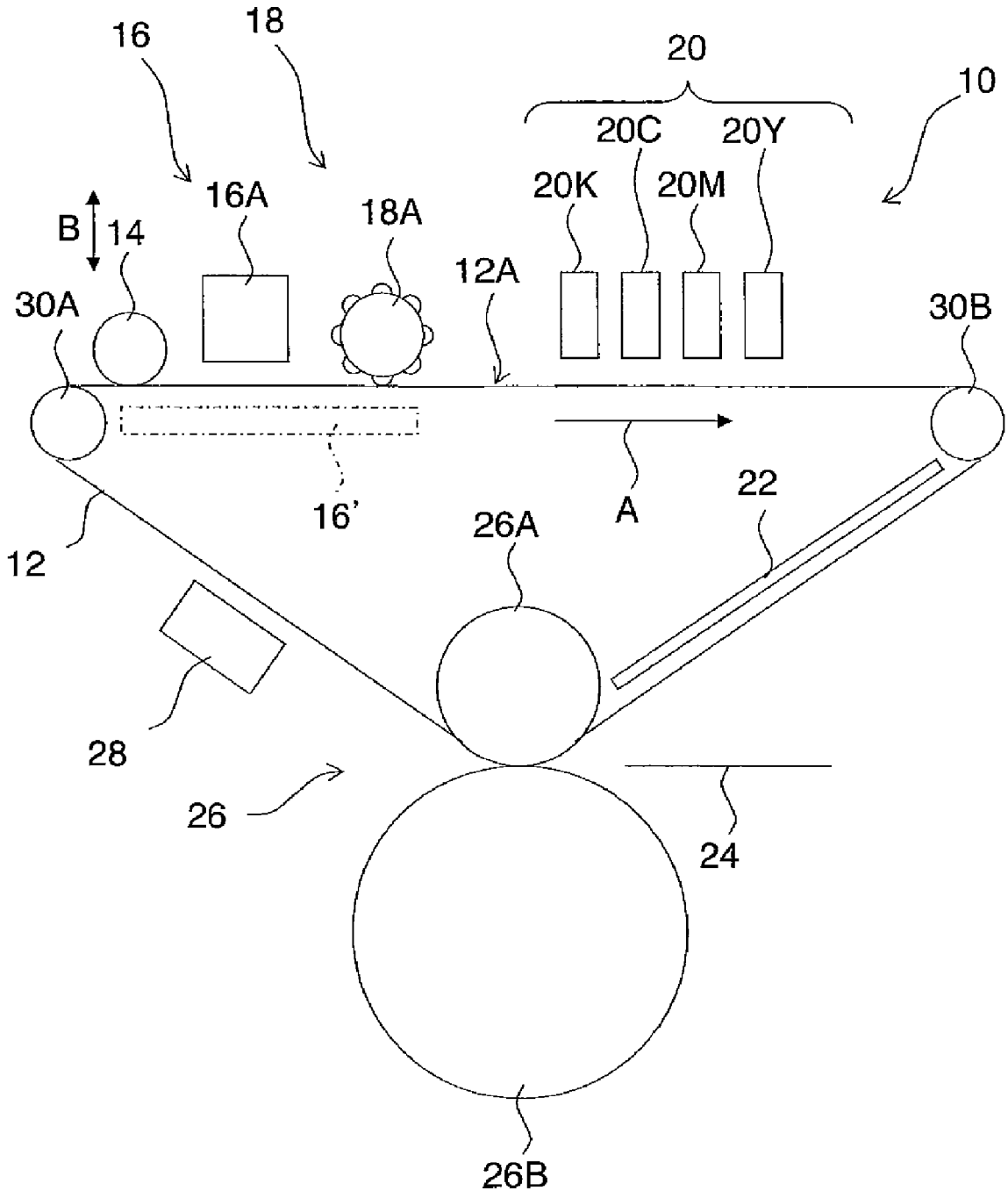
FIG. 1 is a general schematic drawing of an inkjet recording apparatus relating to a first embodiment of the present invention.

FIG. 1 shows the general composition of an inkjet recording apparatus 10 relating to an embodiment of the present invention.

The inkjet recording apparatus 10 according to the present embodiment employs a transfer recording method in which a primary image is formed by ejecting ink droplets onto an intermediate transfer body 12 and the primary image formed on the intermediate transfer body 12 is then transferred onto a recording medium 24.

Furthermore, the inkjet recording apparatus 10 according to the present embodiment is composed in such a manner that the movement of the ink droplets which have been deposited onto the intermediate transfer body 12 is suppressed by forming a prescribed recess-projection shape (concavo-convex shape) in the surface of the intermediate transfer body 12 (image forming surface 12A) prior to forming the primary image, as well as ensuring good transfer properties by flattening the surface of the intermediate transfer body 12 by crushing the recess-projection shape during the recording transfer action.

The inkjet recording apparatus 10 illustrated in FIG. 1 comprises: an intermediate transfer body 12 on which a primary image is formed; a resin liquid application unit 14 which applies a resin liquid formed by a resin dissolved in a solvent, over the whole surface of the image forming region of the image forming surface 12A of the intermediate transfer body 12 prior to formation of the primary image; a drying treatment unit 16 which heats and dries the resin liquid which has been applied to the intermediate transfer body 12; a recess-projection forming unit 18 which forms a recess-projection shape having a prescribed shape in the resin layer after the resin layer (not illustrated in FIG. 1, and indicated by reference numeral 40 in FIG. 2A) has been formed on the intermediate transfer body 12 by drying the resin liquid which has been applied onto the intermediate transfer body 12; a print unit 20 having a plurality of inkjet heads (heads) 20K, 20C, 20M and 20Y which are provided so as to correspond to inks containing coloring materials of respective colors of black (K), yellow (Y), magenta (M) and cyan (C); a heating and drying unit 22 which heats the primary image so as to provisionally fix the primary image formed by the ink droplets ejected from the print unit 20, and also dries the intermediate transfer body 12 on which the primary image is formed; a transfer recording unit 26 which transfers and records the primary image formed on the intermediate transfer body 12 onto a recording medium 24; and a cleaning treatment unit 28 which removes residual ink and resin layer on the image forming region, by cleaning the image forming region of the intermediate transfer body 12 after transfer recording.

Furthermore, although not illustrated in FIG. 1, the inkjet recording apparatus 10 comprises: an ink storage and loading unit which stores ink to be supplied to the respective heads 20K, 20C, 20M and 20Y of the print unit 20; a paper supply unit which accommodates a recording medium 24 onto which the primary image formed on the intermediate transfer body 12 is to be transferred and recorded and supplies this recording medium 24 to the transfer recording unit 26; a separation unit which separates the recording medium 24 from the intermediate transfer body; a fixing unit which fixes the image which has been transferred and recorded onto the recording medium that has been separated from the intermediate transfer body 12; and an output unit which outputs the recording medium that has undergone a fixing process in the fixing unit, to the exterior of the apparatus.

The ink storing and loading unit has ink supply tanks (indicated by reference numeral 60 in FIG. 7) which store inks of colors corresponding to the respective heads, and the inks of the respective colors are connected to the heads via prescribed ink flow channels.

The ink storing and loading unit has a warning device (for example, a display device or an alarm sound generator) for warning when the remaining amount of any ink is low, and for this unit, a device having a mechanism for preventing loading errors among the colors is used.

The intermediate transfer body 12 is an endless belt which is wound about a plurality of tensioning rollers 30A and 30B, and a roller 26A which also serves as the transfer recording unit 26. When at least one of the tensioning rollers (drive rollers) of the tensioning rollers 30A and 30B is rotated, then the intermediate transfer body 12 is moved in a prescribed direction in synchronism with the rotation of the drive roller. For example, when the tensioning roller 30A is taken as the drive roller and caused to rotate in the clockwise direction, then the intermediate transfer body 12 is moved from left to right in FIG. 1 (the direction marked by an arrow indicated by reference symbol A in FIG. 1: the direction of movement of the intermediate transfer body), in the print region directly below the print unit 20.

In the inkjet recording apparatus 10 according to the present embodiment, the speed of movement of the intermediate transfer body 12 is controlled so as to be uniform through the series of image forming processes. The speed of movement of the intermediate transfer body 12 can be changed appropriately in accordance with the ink droplet ejection cycle of the print unit 20 and the resolution of the recorded image. For example, if the ink droplet ejection cycle is uniform, then when the speed of movement of the intermediate transfer body 12 is relatively faster, the resolution of the recorded image becomes coarser, and when the speed of movement of the intermediate transfer body 12 is relatively slower, the resolution of the recorded image becomes finer.

Furthermore, the intermediate transfer body 12 is made of resin, metal, rubber, or the like, and has non-permeable properties that prevent permeation of resin liquid or ink droplets, in at least the image forming region where the primary image is formed, of the image forming surface which opposes the print unit 20. Furthermore, at least the image forming region of the intermediate transfer body 12 is composed so as to have a horizontal surface (flat surface) which has a prescribed flatness.

FIG. 1 shows an endless belt as one mode of the intermediate transfer body 12, but the intermediate transfer body 12 used in the present embodiment may also have a drum shape or a flat plat shape. Furthermore, the intermediate transfer body 12 may be formed by a multiple-layer structure which has a supporting body (supporting layer) having a prescribed rigidity, on the inner side of the surface layer.

Desirable materials for use as the surface layer (an image forming surface) of the intermediate transfer body 12 are, for example, commonly known materials such as: a polyimide resin, a silicone resin, a polyurethane resin, a polyester resin, a polystyrene resin, a polyolefin resin, a polybutadiene resin, a polyamide resin, a polyvinyl chloride resin, a polyethylene resin, a fluorine resin, and the like.

Here, the image forming method employed in the inkjet recording apparatus 10 will be described in terms of the successive steps.

Figure 2A:
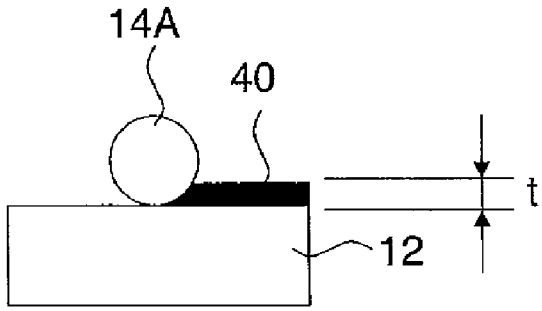
FIGS. 2A to 2D are diagrams showing an image forming method relating to the first embodiment of the present invention.

A resin liquid is applied by the resin liquid application unit 14 onto the whole surface of the image forming region of the intermediate transfer body 12 which has been subjected to a cleaning treatment by the cleaning treatment unit 28. FIG. 2A shows a schematic diagram of this resin liquid application step. The thickness t of the resin layer 40 applied to the intermediate transfer body 12 is desirably in the range of equal to or greater than 1 μm and equal to or less than 10 μm.

The detailed structure of the resin liquid application unit 14 is not illustrated in the drawings, but FIG. 1 depicts a mode where an application roller 14A is provided as an example of the composition of the resin liquid application unit 14. Desirably, a porous material or a material having recess-projection impressions in the surface thereof is used for the application roller 14A illustrated in FIGS. 2A to 2D, and it is possible to use a gravure roller, for example.

Figure 3:
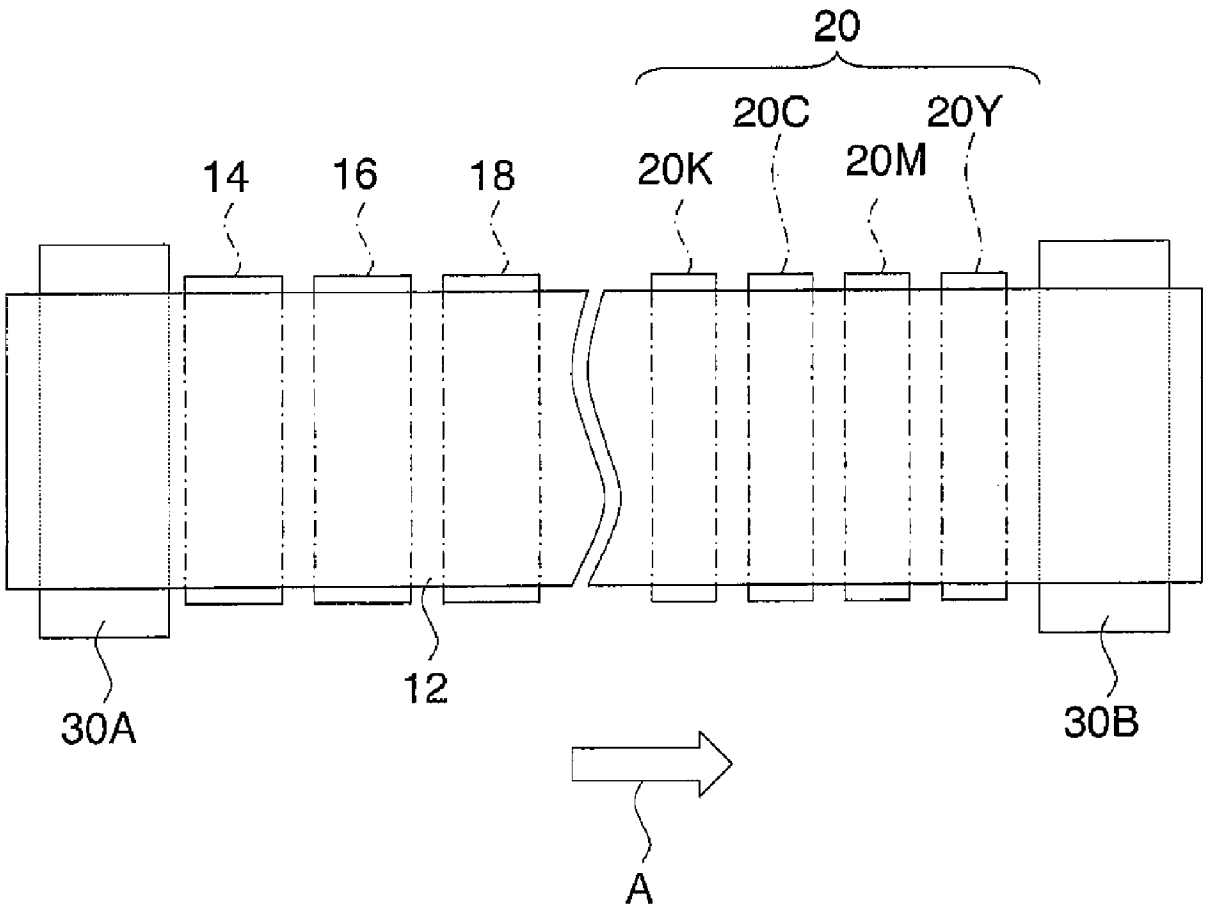
FIG. 3 is a principal plan diagram of the peripheral area of a print unit in the inkjet recording apparatus illustrated in FIG. 1.

Moreover, the application roller 14A has a round cylindrical shape of which the longitudinal direction coincides with the breadthways direction which is perpendicular to the direction of movement of the intermediate transfer body 12 (the direction perpendicular to the plane of the drawing in FIG. 1), and has a structure in which the length in this lengthwise direction is equal to or greater than the width of the intermediate transfer body 12 (the width of the image forming region) (see FIG. 3). Consequently, a resin liquid is applied onto the whole surface of a prescribed region of the intermediate transfer body 12 by moving the application roller 14A and the intermediate transfer body 12 relatively just once, in a mutually contacting state. The lengthwise direction of the application roller 14A may also be an oblique direction which forms a prescribed angle $\alpha$ (where $0° < \alpha \leqq 90°$) with respect to the direction of movement of the intermediate transfer body 12. Furthermore, it is also possible to adopt a composition in which a plurality of application rollers each having shorter length than the width of the intermediate transfer body 12 are disposed in the breadthways direction of the intermediate transfer body 12, so as to correspond to the width of the intermediate transfer body 12. It is desirable to adopt a staggered arrangement as the method of arranging such a plurality of application rollers.

Moreover, the application roller 14A is composed so as to allow switching between contact with and separation from the intermediate transfer body 12, as well as being composed so as to allow it to rotate idly when the intermediate transfer body 12 is moved while the application roller 14A is in a state of contact with the intermediate transfer body 12. In other words, the application roller 14A is supported by an axle which is parallel to the lengthwise direction, and is rotatable about this axle, which serves as a rotating axle.

To give one example of a composition for switching between contact and separation of the application roller 14A and the intermediate transfer body 12 (namely, changing the distance between the application roller 14A and the intermediate transfer body 12), there is a mode comprising a movement mechanism which moves the application roller 14A in the vertical direction indicated by reference symbol B in FIG. 1.

Furthermore, the resin liquid application unit 14 is composed so as to enable variation and control of the amount of resin liquid applied.

If the speed of movement of the application roller 14A is uniform and the pressing force of the application roller 14A and the intermediate transfer body 12 is raised, then the amount of resin liquid applied to the intermediate transfer body 12 is increased, and if the pressing force between the application roller 14A and the intermediate transfer body 12 is reduced, then the amount of resin liquid applied is reduced. Of course, it is also possible to adopt a mode where the amount of resin liquid applied is altered by changing the speed of movement of the intermediate transfer body 12, or a mode where the speed difference between the intermediate transfer body 12 and the application roller 14A is altered. Furthermore, it is also possible to adopt a mode where a plurality of resin liquids having different physical properties, such as viscosity or surface tension, are prepared in advance and a suitable resin liquid is selected in order to achieve a desired thickness of the resin layer, or a mode where a plurality of resin liquids having substantially the same physical properties, such as the viscosity and surface tension, and different concentrations of resin are prepared and a suitable resin liquid is selected in order to achieve a desired thickness of the resin layer.

Apart from an application roller, it is also possible to use a blade or the like as the application member for applying resin liquid. Furthermore, as a method of applying the resin liquid to the intermediate transfer body 12 by a non-contact technique, it is possible to adopt a spray method which sprays the resin liquid droplets which has been formed into very fine droplets, or the like.

The present embodiment describes an example of a mode which uses a resin liquid formed by dissolving a resin material in a solvent, but it is also possible to apply a resin material in a solid state or a semi-solid state, directly onto the intermediate transfer body. For example, in one possible method, a solid (or semi-solid) resin material is supplied to the intermediate transfer body 12, the resin material is softened by heating, and the resin material is then spread evenly by means of a squeegee, or the like. From the viewpoint of handling, it is desirable to use a liquid since this allows easy handling.

It is suitable to use a thermoplastic resin as the resin material which is used in the resin liquid of the present embodiment. A thermoplastic resin has properties whereby it softens when heated to the glass transition temperature or melting point, and therefore this type of resin is desirable since it facilitates processing to a desired shape when creating the recess-projection shape after forming the resin layer.

For the thermoplastic resin, it is also possible to use a resin which is soluble in an aqueous medium or a resin which is insoluble in an aqueous medium. As to a resin which is soluble in an aqueous medium, it is appropriate to use a resin dispersant which, for example, disperses pigment particles (coloring material particles) in the ink solvent. Furthermore, in a case of a resin which is insoluble in an aqueous medium, it is desirable to add the resin particles to the solvent in the form of a resin emulsion. The resin emulsion referred to here comprises water, which is in a continuous phase, and a resin component (thermoplastic resin component), which is in a dispersed phase, for example.

A thermoplastic resin formed by a polymer having both a hydrophilic part and a hydrophobic part is desirable. If a resin emulsion is used as the thermoplastic resin, then although there are no particular restrictions on the particle size provided that the resin forms an emulsion, desirably, the particle size is equal to or less than approximately 150 μm, and more desirably equal to or greater than approximately 5 nm and equal to or less than approximately 100 nm.

As the thermoplastic resin, it is possible to use a dispersed resin as employed conventionally in an ink composition for inkjet recording, and a resin composition similar to the resin emulsion. Specific examples of a thermoplastic resin include: acryl polymers, such as polyacrylate ester and a copolymer of same, polymethacrylate ester and a copolymer of same, polyacrylonitrile and a copolymer of same, polcyanoacrylate, polyacrylamide, polyacrylic acid, and polymethacrylic acid; a polyolefine copolymer, such as polyethylene, polypropylene, polybutene, polyisobutylene, polystyrene and a copolymer of same, petroleum resin, coumarone-indene resin, and terpene resin; a vinyl acetate-vinyl alcohol polymer, such as vinyl polyacetate and a copolymer of same, polyvinyl alcohol, polyvinyl acetal, and polyvinyl ether; a halogen-containing polymer, such as polyvinyl chloride and a copolymer of to same, polyvinylidene chloride, a fluorine resin, and a fluorine rubber; a nitrogen-containing vinyl polymer; such as polyvinyl carbazole, polyvinyl pyrrolidone and a copolymer of same, polyvinyl pyridine, and polyvinyl imidazole; a diene polymer, such as polybutadiene and a copolymer of same, polychloroprene, and polyisoprene (butyl rubber); and other open-ring polymer resins, condensed polymer resins, and natural polymer resins, and the like.

If the thermoplastic resin is to be obtained in an emulsified state, then it can be prepared by mixing resin particles in water, together with a surfactant depending on the circumstances. For example, an emulsion of acrylic resin or styrene-acrylic acid copolymer resin can be obtained by mixing a (meth)acrylic acid ester resin or styrene-(meth)acrylic acid ester resin with water, and depending on the circumstances, a (meth)acrylate resin and a surfactant. The mixing ratio of the resin component and the surfactant is desirably in the range of around 50:1 to 5:1 in general. If the use amount of the surfactant is below this range, then it becomes difficult to form an emulsion, and if it exceeds this range, then there is a tendency for the waterproofing characteristics of the resin layer to deteriorate, and the adhesion of the resin layer to the intermediate transfer body 12 to become worse.

There are no particular restrictions on the surfactant used in the present embodiment, but desirable examples include: amionic surfactants (for example, sodium dodecylbenzane sulfonate, sodium laureate, an ammonium salt of polyoxyethylene alkyl ether sulfate, and the like), nonionic surfactants (for example, a polyoxyethylene alkyl ether, a polyoxyethylene alkyl ester, a polyoxyethylene sorbitan fatty acid ester, a polyoxyethylene alkyl phenyl ether, a polyoxyethylene alkyl amine, a polyoxyethylene alkyl amide, and the like), and it is also possible to use a combination of two or more of these surfactants.

Moreover, it is possible to obtain an emulsion of a thermoplastic resin by emulsification polymerization of a monomer of the aforementioned resin component, in water containing a polymerization catalyst and an emulsifier. The polymerization initiator, emulsifier and molecular weight adjuster used for emulsification polymerization may be those used according to a standard method.

The ratio between the resin forming the dispersed phase component and the water is desirably in the range of equal to or greater than 60 parts by weight and equal to or less than 400 parts by weight of water, and more desirably in the range of equal to or greater than 100 parts by weight and equal to or less than 200 parts by weight of water, with respect to 100 parts by weight of resin.

If a resin emulsion is used as the thermoplastic resin, then it is also possible to use a commonly known resin emulsion. For example, it is possible to use directly the resin emulsion described, for example, in Japanese Examined Patent Application Publication No. 62-1426, Japanese Patent Application Publication No. 3-56573, Japanese Patent Application Publication No. 3-79678, Japanese Patent Application Publication No. 3-160068 or Japanese Patent Application Publication No. 4-18462, or the like. Furthermore, it is also possible to use a commercial resin emulsion, for example, Microgel E-1002 or E-5002 (styrene-acrylic resin emulsion, made by Nippon Paint Co., Ltd.), Boncoat 4001 (acrylic resin emulsion, made by Dainippon Ink and Chemicals Incorporated), Boncoat 5454 (styrene-acrylic resin emulsion, made by Dainippon Ink and Chemicals Incorporated), SAE-1014 (styrene-acrylic resin emulsion, made by Zeon Japan Corp.) or Saibinol SK-200 (acrylic resin emulsion, made by Saiden Chemical Industry Co., Ltd.).

The drying treatment unit 16 which is provided to the downstream side of the resin liquid application unit 14 in terms of the direction of movement of the intermediate transfer body heats the intermediate transfer body 12 onto which the resin liquid has been applied to evaporate the solvent of the resin liquid, thereby forming a solid or semi-solid resin layer on the intermediate transfer body 12. A flat plate-shaped infrared heater is suitable for use as the drying treatment unit 16, and is composed so as to have a heating range which can be varied between 50° C. and 150° C. FIG. 1 shows a mode where a drying treatment unit 16 is provided at a position opposing the image forming surface 12A of the intermediate transfer body 12, but as further compositional examples of a drying treatment unit 16, it is also possible to adopt a mode where a heater is built into the intermediate transfer body 12, and a mode where a heater is provided on the opposite side of the image forming surface 12A, namely, on the rear side of the intermediate transfer body 12. In FIG. 1, the drying treatment unit 16' provided on the opposite side of the intermediate transfer body 12 from the image forming surface 12A is indicted by a single-dotted line.

Figure 2B:
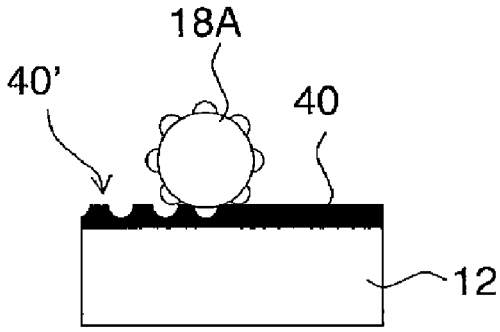

The recess-projection forming unit 18 which is provided to the downstream side of the drying treatment unit 16 in terms of the direction of movement of the intermediate transfer body uses a method in which a recess-projection roller 18A which has a plurality of projections formed in the surface thereof is passed over the resin layer on the intermediate transfer body 12, thereby transferring the recess-projection shape of the recess-projection roller 18A to the resin layer. The material of the recess-projection roller 18A should be harder than the resin layer formed on the intermediate transfer body 12, and it is suitable to use plastic or metal for same. FIG. 2B shows a schematic drawing of the recess-projection processing step performed by the recess-projection forming unit 18 (recess-projection roller 18A).

The recess-projection roller 18A used in the present example has a rotating axle in a direction perpendicular to the direction of movement of the intermediate transfer body 12 (or a direction which forms a prescribed angle $\beta$ ($0° < \beta \leqq 90°$) with respect to the direction of movement of the intermediate transfer body 12), and has a structure whereby when the intermediate transfer body 12 is moved in a state of contact with the intermediate transfer body 12 (resin layer 40), it rotates idly in accordance with the movement of the intermediate transfer body 12. When the intermediate transfer body 12 is moved in a state where the (recess-projection) surface of the recess-projection roller 18A is abutted against the resin layer, then the recess-projection roller 18A forms recess-projection impressions in the resin layer while rotating idly in accordance with the movement of the intermediate transfer body 12. The reference numeral 40' in FIG. 2B represents the resin layer after the formation of the recess-projection impressions.

A recess-projection shape can be formed easily in the resin layer, by incorporating a heater into the recess-projection roller 18A or disposing a heater on the other side of the intermediate transfer body 12 at a position opposing the recess-projection roller 15A, and also providing a heater inside the intermediate transfer body 12, and heating the intermediate transfer body 12 or the resin layer formed in the intermediate transfer body 12 while passing the recess-projection roller 15A over same. In a mode where a heater is provided on the opposite side of the intermediate transfer body 12 from the recess-projection roller 18A, or a mode where a heater is incorporated inside the intermediate transfer body 12, this heater also desirably serves as the heater of the drying treatment unit 16 and the heater of the recess-projection forming unit 18.

The length of the recess-projection roller 18A in the lengthwise direction corresponds to the width of the intermediate transfer body 12 (the width of the image forming region). For example, it is possible to make the length of the recess-projection roller 18A in the lengthwise direction equal to the width of the intermediate transfer body 12, or to adopt a structure where the length of the recess-projection roller 18A in the lengthwise direction is greater than the width of the intermediate transfer body 12 (see FIG. 3). Furthermore, it is also possible to align a plurality of rollers, each having a length that is shorter than the width of the intermediate transfer body 12, so as to correspond to the width of the intermediate transfer body 12. The plurality of recess-projection rollers 18A are desirably arranged in a staggered matrix arrangement.

A desirable mode is one where the nip pressure and the nip length (nip time) of the recess-projection roller 18A are altered suitably in accordance with the thickness t of the resin layer 40 (see FIG. 2A) and the type of resin (hardness of the resin), when forming the recess-projection shape in the resin layer 40 in FIG. 2A. For example, the nip pressure can be controlled in such a manner that if the thickness t of the resin layer 40 is relatively large, then the nip pressure is made relatively high and if the thickness t of the resin layer 40 is relatively small, then the nip pressure is made relatively small.

Furthermore, it is also possible to implement control whereby, if the thickness t of the resin layer 40 is relatively high, then the nip length can be made relatively long, and if the thickness t of the resin layer 40 is relatively small, then the nip length can be made relatively short. If the nip length is changed, then it becomes necessary to alter the speed of movement of the intermediate transfer body 12, and therefore it is desirable to control the nip pressure.

FIG. 2B shows a resin layer 40' in which a recess-projection shape has been formed. The cycle of the recess-projection impressions in the resin layer 40' (indicated by the reference symbol P in FIGS. 4A and 4B) is set so as to be smaller than the cycle between dots, and desirably it is not less than four times and not more than ten times the resolution of the primary image, and desirably it is not less than 1/15 and not more than 1/6 of the dot diameter. More specifically, if the resolution of the primary image is 1200 dpi, and the minimum value of the dot diameter is 30 μm, then it is desirable that the cycle of the recess-projection impressions should be 5 μm or less, and more desirably, 1 μm or less. Furthermore, desirably, the amplitude of the recess-projection impressions formed in the resin layer 40' is Ra>0.2 μm and more desirably, Ra>1.2 μm.

Figure 4A:
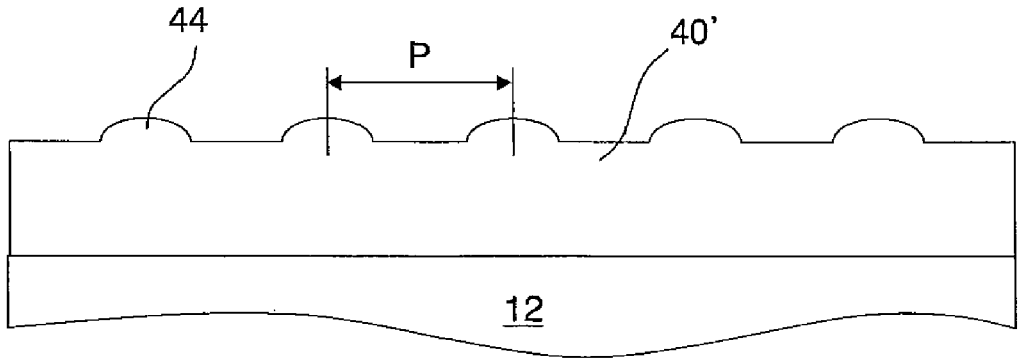
FIGS. 4A to 4C are diagrams illustrating concrete examples of a recess-projection shape.
Figure 4B:
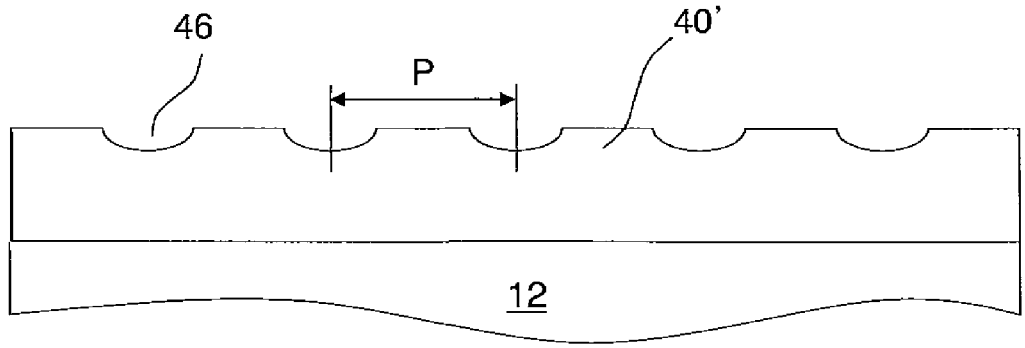

FIGS. 4A and 4B show concrete examples of a recess-projection shape (cross-sectional shape) arranged at a cycle (pitch) of P. FIG. 4A shows a resin layer 40' which comprises smooth projecting sections. The projecting sections 44 illustrated in FIG. 4A have a substantially semicircular cross-sectional shape, and a substantially circular planar shape. In other words, the three-dimensional shape of the projecting sections 44 is formed in a substantially hemispherical shape (dome shape). Furthermore, FIG. 4B shows a resin layer 40' which comprises smooth recess sections 46. The recess sections 46 illustrated in FIG. 4B have a substantially semicircular cross-sectional shape and a substantially circular planar shape, and hence the three-dimensional shape of the recess sections 46 is a substantially hemispherical shape. A desirable mode is one in which the projecting sections 44 illustrated in FIG. 4A and the recess sections 46 illustrated in FIG. 4B are provided in combination. For example, it is possible to arrange the projecting sections 44 illustrated in FIG. 4A and the recess sections 46 illustrated in FIG. 4B, in an alternating fashion.

Figure 4C:
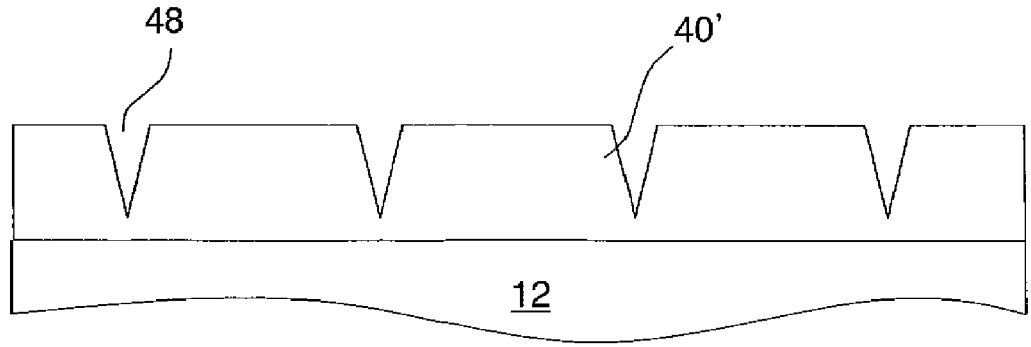

On the other hand, a shape which comprises occasional sharp recess sections 48 such as those illustrated in FIG. 4C (with an acute angle) is not suitable as the recess-projection shape of the present embodiment. A resin layer having sharp angled recess sections 48, such as a substantially triangular cross-sectional shape (a three-dimensional shape which is a substantially triangular cone shape or wedge shape) will not allow the ink (coloring material) contained in the recess sections 48 to make satisfactory contact with the recording medium, even if the resin layer 40' is deformed during the transfer recording action. Furthermore, an anchoring effect occurs between the ink droplets (dots) and it becomes difficult to ensure satisfactory transfer properties. Consequently, recess sections 48 having a sharp angle such as those illustrated in FIG. 4C are not suitable for the recess-projection shape of the present embodiment.

Although not illustrated in the drawings, in the resin layer 40', a recess-projection shape formed by the projecting sections 44 illustrated in FIG. 4A and the recess sections 46 illustrated in FIG. 4B is arranged in a two-dimensional fashion. In the arrangement pattern of the recess-projection shape, the cycle (arrangement pitch) in the direction of movement of the intermediate transfer body and the cycle in the direction perpendicular to the direction of movement of the intermediate transfer body may be the same, or the cycle in the direction of movement of the intermediate transfer body and the cycle in the direction perpendicular to the direction of movement of the intermediate transfer body may be different. Furthermore, it is also possible to combine a plurality of cycles in respect of the direction of movement of the intermediate transfer body (the direction perpendicular to the direction of movement of the intermediate transfer body). Moreover, it is also possible to employ various arrangement patterns, such as a staggered arrangement, a radiating arrangement, a concentric circular arrangement (donut shaped arrangement), and the like.

In the present embodiment, a mode is described in which a recess-projection shape is formed in a resin layer by using a roller-shaped member having on its surface a recess-projection shape corresponding to the shape that is to be formed in the resin layer, but it is also possible to form a recess-projection shape in the resin layer by forming a recess-projection shape corresponding to the recess-projection shape that is to be formed in the resin layer, in a flat plate-shaped member which corresponds to the surface area of the image forming region, and to form the recess-projection shape in the resin layer by abutting this flat plate-shaped member against the resin layer. In this case, desirably, the intermediate transfer body 12 is halted or slowed during formation of the recess-projection shape in the resin layer.

Furthermore, in the present embodiment, a mode is described in which a resin layer 40 is formed on the intermediate transfer body 12 and a recess-projection shape is then formed in the image forming surface 12A of the intermediate transfer body 12 by processing this resin layer, but it is also possible to form a recess-projection shape by dispersing resin micro-particles on the image forming surface 12A of the intermediate transfer body 12. For example, if a dispersion obtained by dispersing resin micro-particles in a solvent is deposited onto the image forming surface 12A of the intermediate transfer body 12 and the dispersion is dried by means of the drying treatment unit 16, then since recess-projection impressions are formed by the resin micro-particles themselves, it may not be necessary to carry out processing by means of the recess-projection roller 18A, and hence the formation of the resin layer on the image forming surface 12A also serves as a step of forming a recess-projection shape of the image forming surface 12A.

In other words, if resin micro-particles having a diameter of approximately 1 μm to 5 μm are dispersed densely (so as to create contact between mutually adjacent micro-particles), on the image forming surface 12A of the intermediate transfer body 12, then a recess-projection shape corresponding to the shape of the resin micro-particles is formed in the image forming surface 12A of the intermediate transfer body 12 and therefore the processing of the resin layer by the recess-projection forming unit 18 can be omitted.

Figure 2C:
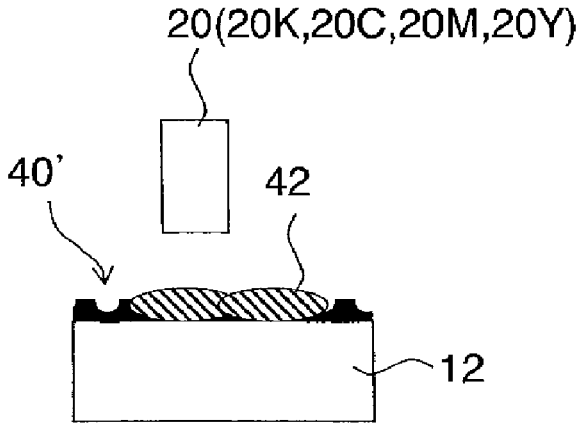

The print unit 20 is disposed to the downstream side of the recess-projection forming unit 18 in terms of the direction of movement of the intermediate transfer body. The print unit 20 ejects droplets of inks of respective colors from heads 20K, 20C, 20M, 20Y in accordance with the image data. FIG. 2C shows a state where a primary image (dot image) 42 has been formed on the image forming surface 12A of the intermediate transfer body 12 by ink droplets ejected from the print unit 20.

The ink droplets (dots) 42 ejected from the print unit 20 are fixed in prescribed positions on the intermediate transfer body 12, rather than moving thereon, due to the recess-projection shape formed in the image forming surface 12A of the intermediate transfer body 12. It is even more desirable to adopt a method in which ink droplets (coloring material particles) are fixed to the intermediate transfer body 12 by means of a two-liquid reaction.

When ink droplets are ejected after depositing a treatment liquid which causes the coloring material dispersed or dissolved in the ink to aggregate or become insoluble onto the intermediate transfer body 12, then aggregation (insolubilization) of the ink droplets occurs on the intermediate transfer body 12 and the ink droplets become fixed rapidly to the intermediate transfer body 12. Consequently, phenomena such as landing interference, displacement of the dot positions, or bleeding between different colors, are prevented. In the resin liquid application step illustrated in FIG. 2A, it is possible to apply a mixed liquid comprising resin liquid mixed with a treatment liquid onto the intermediate transfer body.

In the two-liquid aggregation method described above, a solvent removal unit is provided after the print unit 20 to remove unwanted solvent component from the intermediate transfer body 12. The solvent removal unit removes unwanted solvent component from the intermediate transfer body 12 by contacting a roller or the like having an absorbing member, such as a porous member, provided on the surface thereof, against the intermediate transfer body 12.

After a primary image is formed on the intermediate transfer body 12, a preheating process is applied to the intermediate transfer body 12 on which the primary image has been formed, by the heating and drying unit 22 which is provided to the downstream side of the print unit 20 in terms of the direction of movement of the intermediate transfer body. In the present embodiment, a flat plate-shaped infrared heater is used as the heating and drying unit 22, and the heating temperature of the pre-heating process is set to 50° C. to 120° C. In a mode where a heater is incorporated into the intermediate transfer body 12, it is possible to use one and the same heater as the heater of the drying treatment unit 16 and the heater of the heating and drying unit 22.

In the pre-heating treatment performed by the heating and drying unit 22, the solvent component present in the vicinity of the primary image is evaporated off, and furthermore, by raising the temperature of the primary image and the vicinity thereof to a temperature which is somewhat lower than the temperature suitable for transfer recording, it is possible to shorten the heating time required during the transfer recording operation.

Figure 2D:
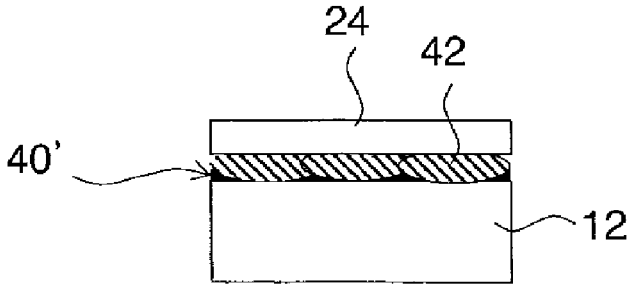

The primary image which has been subjected to pre-heating treatment is transferred and recorded onto the recording medium 24 by the transfer recording unit 26. FIG. 2D shows the transfer recording step. In the transfer recording step, the recording medium 24 is supplied from a paper supply unit (not illustrated) and between the heating roller 26A and the pressurization roller 26B by means of a prescribed supply path, the recording medium 24 is sandwiched between the pressurization roller 26B in FIG. 1 and the intermediate transfer body 12, and by applying a prescribed pressure by means of the pressurization roller 26B while heating to a prescribed temperature by means of the heater incorporated into the heating roller 26A, the primary image formed on the intermediate transfer body 12 is recorded by transfer onto the recording medium 24.

Possible examples of the composition of the paper supply unit described above include a cassette in which cut paper is loaded in a stacked fashion, and a magazine for rolled paper (continuous paper). It is also possible to use a plurality of cassettes in combination to correspond to recording media having different widths, qualities, and so on. Moreover, paper may also be supplied in cassettes which contain cut paper loaded in a stacked state, in lieu of or in combination with magazines for rolled paper (continuous paper).

In the case of a configuration in which a plurality of types of recording paper can be used, it is desirable that an information recording medium such as a bar code or a wireless tag containing information about the type of paper should be attached to the cassette, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

In the case of the configuration in which roll paper is used, a cutter is provided at a stage prior to the transfer recording unit, and the roll paper is cut into a desired size by the cutter. The cutter has a stationary blade of which length is not less than the width of the conveyor pathway for the recording medium, and a round blade which moves along the stationary blade. The stationary blade is disposed on the reverse side of the printed surface of the recording medium, and the round blade is disposed on the printed surface side across the conveyance path from the reverse side.

Furthermore, concrete examples of the recording medium 24 used in the present embodiment include: normal paper, permeable media such as special inkjet paper, non-permeable media, low-permeability media such as coated paper, sealed paper having adhesive and a detachable label on the rear surface thereof, a resin film such as an OHP sheet, a metal sheet, cloth, wood and other types of media.

In the transfer recording step illustrated in FIG. 2D, since the recess-projection impressions in the resin layer 40' disappear due to the pressure applied during the transfer recording action, then it is possible to transfer the coloring material (primary image) to the recording medium 24 in a satisfactory fashion. In other words, due to the transfer pressure applied to the intermediate transfer body 12 and the recording medium 24 during the transfer recording step, the projections and indentations in the resin layer 40' to which the primary image is fixed are crushed, thereby flattening the resin layer 40', and the transfer properties of the image from the intermediate transfer body 12 to the recording medium 24 are improved.

Furthermore, in the present embodiment, since a thermoplastic resin is used for the resin layer 40 (40'), then further flattening of the resin layer 40' can be expected due to the heat applied during the transfer recording action.

In the transfer recording step according to the present embodiment, the transfer temperature is set in the range of 50° C. to 150° C., and the transfer pressure is set in the range of 0.5 MPa to 3.0 MPa. The transfer temperature and the transfer pressure are desirably adjusted appropriately in accordance with the type of recording medium (material, thickness, etc.), or the type of ink used. For example, if the thickness of the recording medium 24 is relatively thick, then the transfer pressure is made relatively lower, and if the thickness of the recording medium 24 is relatively thin, then the transfer pressure is made relatively higher. Furthermore, if the surface of the recording medium 24 is relatively rough (for example, if normal paper is used), then the transfer pressure is set to a relatively high pressure, and if the surface of the recording medium 24 is relatively smooth (for example, if using photographic paper or coated paper), then the transfer pressure is set to a relatively low pressure.

As a device for adjusting the transfer pressure during transfer and recording in the transfer and recording unit 26, it is possible to employ a mechanism (drive device) which moves the pressurization roller 26B in the vertical direction in FIG. 1. In other words, if the heating roller 26A (and/or the pressurization roller 26B) is moved in a direction which increases the clearance between the heating roller 26A and the pressurization roller 2613, then the transfer pressure becomes lower, and if the heating roller 26A (and/or the pressurization roller 26B) is moved in a direction which reduces the clearance between the heating roller 26A and the pressurization roller 26B, then the transfer pressure becomes greater.

When the transfer recording onto the recording medium 24 has been completed in the transfer recording unit 26, the recording medium 24 bearing the recorded image is separated from the intermediate transfer body 12 in a separation unit (not illustrated), and the recording medium 24 is supplied to a fixing unit.

The separation unit is composed in such a manner that the recording medium 24 becomes detached from the intermediate transfer body 12 due to the rigidity (material strength) of the recording medium 24 and the bending curvature of the separating roller of the intermediate transfer body 12. A device for promoting detachment, such as a separating hook, may also be used in the separation unit. A desirable mode is one where a cooling apparatus for cooling the recording medium 24 is provided between the separation unit and the fixing unit.

Possible examples of a cooling apparatus include a composition where a fan is provided for blowing a cooling air onto the recording medium 24, and a composition where a cooling member, such as a Peltier element or heat sink, is provided.

In the fixing unit (not illustrated), a fixing treatment step is carried out: the image which has been recorded onto the recording medium 24 is fixed by applying heat and pressure. The fixing unit has, for example, a heating roller pair in which the temperature can be adjusted in the range of 50° C. to 200° C. A desirable mode is one where the heating temperature of the fixing unit is 130° C., and the pressure is 0.5 MPa to 3.0 MPa. The heating temperature of the fixing unit is desirably set in accordance with the glass transition temperature of the polymer micro-particles contained in the ink, or the like.

If the ink contains resin micro-particles or polymer micro-particles, then it is possible to improve the fixing properties/rubbing resistance by forming a film of polymer micro-particles (namely, forming a thin film of dissolved micro-particles on the outermost surface layer of the image). If both transfer properties and film manufacturing characteristics can be achieved satisfactorily in the transfer step in the transfer unit 26, then it is also possible to adopt a mode in which the fixing unit is omitted.

When the fixing treatment step has been completed, the recording medium 24 bearing the recorded image is output to the exterior of the apparatus. Although not illustrated in the drawings, a desirable mode is one where a collection tray is provided for accommodating the recording media 24 output to the exterior of the apparatus.

After completing the transfer recording step onto the recording medium 24, the intermediate transfer body 12 is subjected to a cleaning process by the cleaning treatment unit 28. The cleaning treatment unit 28 comprises: a blade (not illustrated) which abuts against the image forming surface 12A of the intermediate transfer body 12 and wipes and removes the residual ink and the resin layer 40' of which the recess-projection impressions have been crushed; and a recovery unit (not illustrated) which recovers the residual ink and resin layer 40' that have been removed. The composition of the cleaning treatment unit 28 which removes the residual material from the intermediate transfer body 12 is not limited to the example given above, and it is also possible to adopt a system based on nipping with brush roller or water-absorbing roller, or the like, an air blower system which blows clean air, an adhesive roller system, or a combination of these systems. In the case of the configuration of nipping with the cleaning roller, it is preferable to make the linear velocity of the cleaning roller different to that of the belt, in order to improve the cleaning effect.

Description of Print Unit

Next, the print unit 20 illustrated in FIG. 1 will be described in detail. The heads 20K, 20C, 20M and 20Y of the print unit 20 are each full-line heads having a length corresponding to the maximum width of the image forming region of the intermediate transfer body 12 (see FIG. 3), and having a plurality of nozzles for ejecting ink (not illustrated in FIG. 3 and indicated by reference numeral 51 in FIGS. 5A to 5C) arranged through the full width of the image forming region.

The heads 20K, 20C, 20M and 20Y are disposed in the color order, black (K), cyan (C), magenta (M), yellow (Y), from the upstream side following the direction of movement of the intermediate transfer body 12, and each of the heads 20K, 20C, 20M and 20Y is fixed so as to extend in the direction perpendicular to the direction of movement of the intermediate transfer body 12.

By adopting a configuration in which full line heads having nozzle rows covering the full width of the intermediate transfer body 12 are provided for respective colors of ink, it is possible to record a primary image on the image forming region of the intermediate transfer body 12 by performing just one operation of moving the intermediate transfer body 12 and the print unit 20, relatively, in the direction of movement of the intermediate transfer body 12 (the sub-scanning direction, see FIG. 5A), (in other words, by means of one sub-scanning action). Accordingly, it is possible to achieve higher speed printing compared to a system including a serial (shuttle) type of head in which the heads 20K, 20C, 20M and 20Y are moved back and forth reciprocally in the main scanning direction which is perpendicular to the direction of movement of the intermediate transfer body 12 (see FIG. 5A), and therefore the print productivity can be improved.

Although a configuration with four standard colors, K Y M and C, is described in the present embodiment, the combinations of the ink colors and the number of colors are not limited to these, and light inks, dark inks, and special color inks can be added as required. For example, a configuration is possible in which ink heads for ejecting light-colored inks, such as light cyan and light magenta, are added, and there is no particular restriction on the arrangement sequence of the heads of the respective colors.

Structure of the Head

The structure of the heads 20K, 20C, 20M and 20Y of the print unit 20 are described in detail below. Since the heads 20K, 20C, 20M and 20Y have a common structure, then the heads are represented below by the reference numeral 50.

Figure 5A:
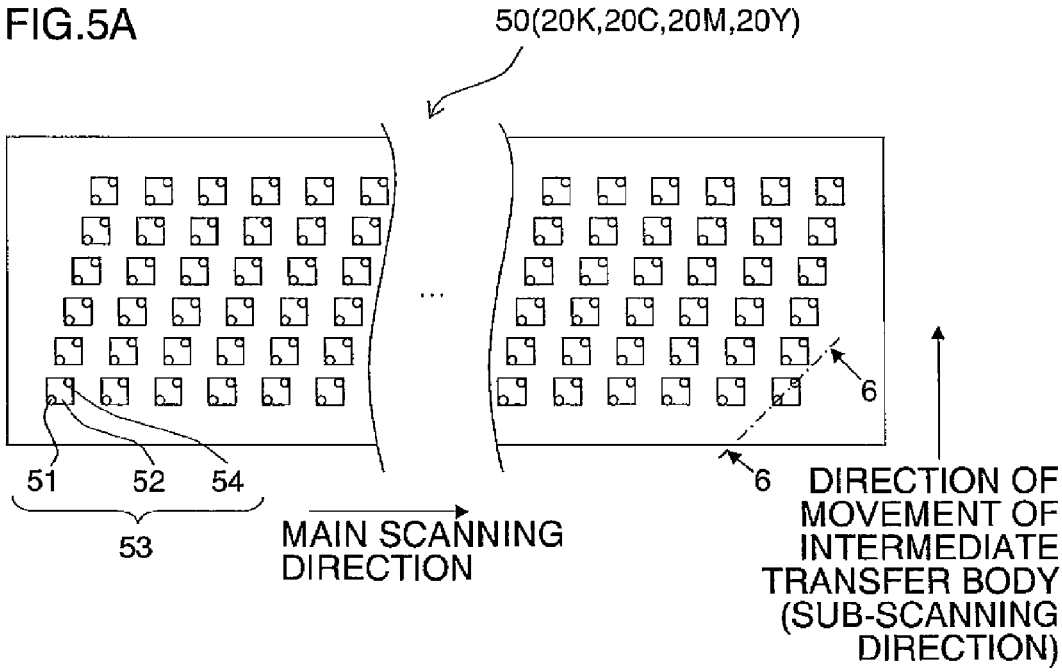
FIGS. 5A to 5C are plan view perspective diagrams showing examples of the composition of the head illustrated in FIG. 1.
Figure 5B:
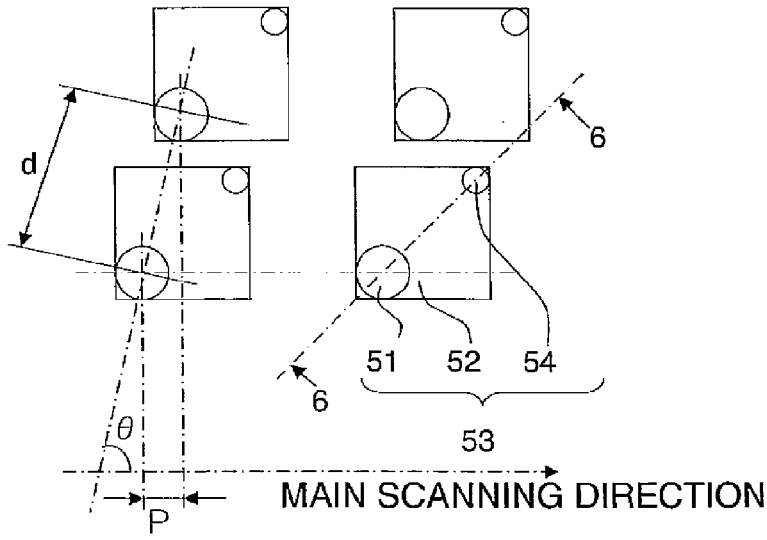
Figure 5C:
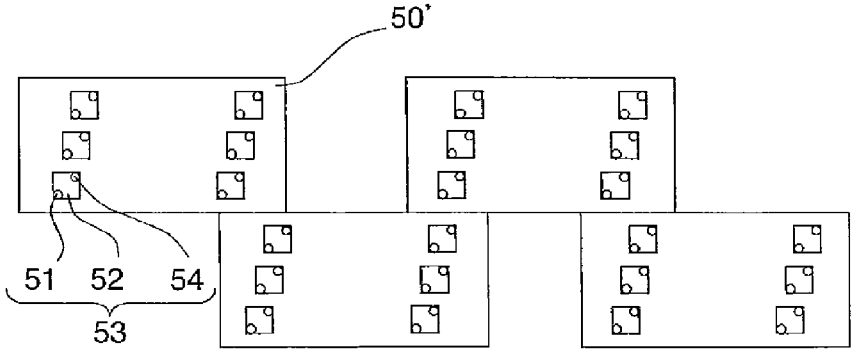
Figure 6:
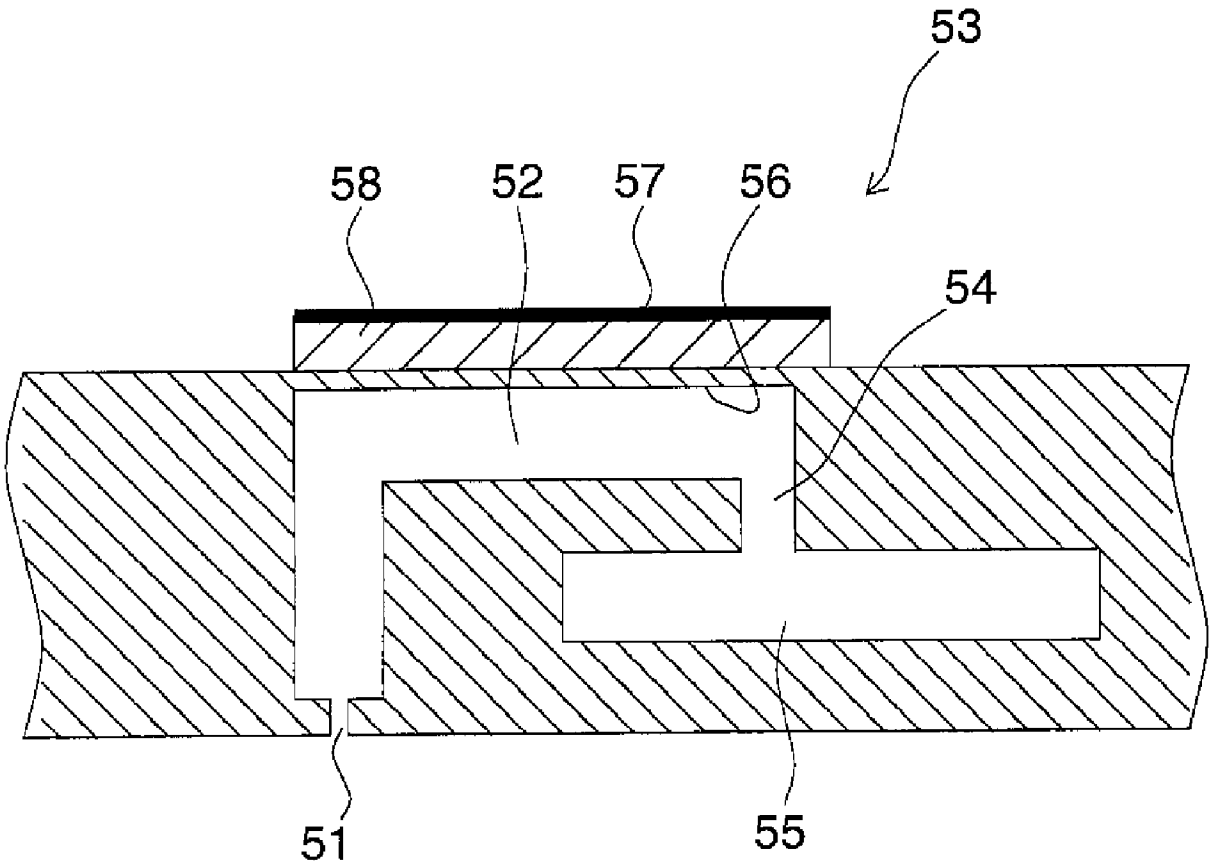
FIG. 6 is a cross-sectional diagram along line 6-6 in FIGS. 5A to 5B.

FIG. 5A is a plan view perspective diagram showing an example of the structure of the head 50, and FIG. 5B is an enlarged diagram of a portion of same. FIG. 5C is a perspective plan view showing another example of the configuration of the head 50, and FIG. 6 is a cross-sectional view (a cross-sectional view taken along the line 6-6 in FIGS. 5A and 5B), showing the inner structure of an ink chamber unit.

The nozzle pitch in the head 50 is desirably decreased in order to increase the density of the dots formed on the surface of the intermediate transfer body 12. As illustrated in FIGS. 5A and 5B, the head 50 according to the present embodiment has a structure in which a plurality of ink chamber units 53, each comprising a nozzle 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the intermediate transfer body 12 in the direction substantially perpendicular to the movement direction of the intermediate transfer body 12 is not limited to the example described above. For example, instead of the configuration illustrated in FIG. 5A, as illustrated in FIG. 5C, a line head having nozzle rows of a length corresponding to the entire width of the intermediate transfer body 12 can be formed by arranging and combining, in a staggered matrix, short head blocks 50' having a plurality of nozzles 51 arrayed in a two-dimensional fashion. Furthermore, although not illustrated in the drawings, it is also is possible to compose a line head by arranging short heads in one row.

The pressure chambers 52 provided corresponding to the respective nozzles 51 are each approximately square-shaped in plan view, and a nozzle 51 and a supply port 54 are provided respectively at either corner of a diagonal of each pressure chamber 52. Each pressure chamber 52 is connected via the supply port 54 to a common flow channel 55. The common flow channel 55 is connected to an ink supply tank which forms an ink source (not illustrated in FIGS. 5A and 5B, and indicated by reference numeral 60 in FIG. 7). The ink supplied from the ink supply tank is distributed and supplied to the respective pressure chambers 52 via the common flow channel 55 in FIG. 6.

Piezoelectric elements 58 each provided with an individual electrode 57 are joined to a diaphragm 56 which forms the upper face of the pressure chambers 52 and which serves as a common electrode, and each piezoelectric element 58 is deformed when a drive voltage is supplied to the corresponding individual electrode 57, thereby causing ink to be ejected from the corresponding nozzle 51. When ink is ejected, new ink is supplied to the pressure chamber 52 from the common flow channel 55, via the supply port 54.

In the present example, a piezoelectric element 58 is used as an ink ejection force generating device which causes ink to be ejected from a nozzle 51 provided in the head 50, but it is also possible to employ a thermal method in which a heater is provided inside each pressure chamber 52 and ink is ejected by using the pressure of the film boiling action caused by the heating action of this heater.

As illustrated in FIG. 5B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the examples illustrated in the drawings, and it is also possible to apply various other types of nozzle arrangements, such as an arrangement structure having one nozzle row in the sub-scanning direction.

Furthermore, the scope of application of the present invention is not limited to a printing system based on a line type of head, and it is also possible to adopt a serial system where a short head which is shorter than the breadthways dimension of the intermediate transfer body 12 is moved in the breadthways direction of the intermediate transfer body 12, thereby performing printing in the breadthways direction, and when one printing action in the breadthways direction has been completed, the intermediate transfer body 12 is moved through a prescribed amount in the direction perpendicular to the breadthways direction, printing in the breadthways direction of the intermediate transfer body 12 is carried out in the next printing region, and by repeating this sequence, printing is performed over the whole surface of the printing region of the intermediate transfer body 12.

Configuration of a Supply System

Figure 7:
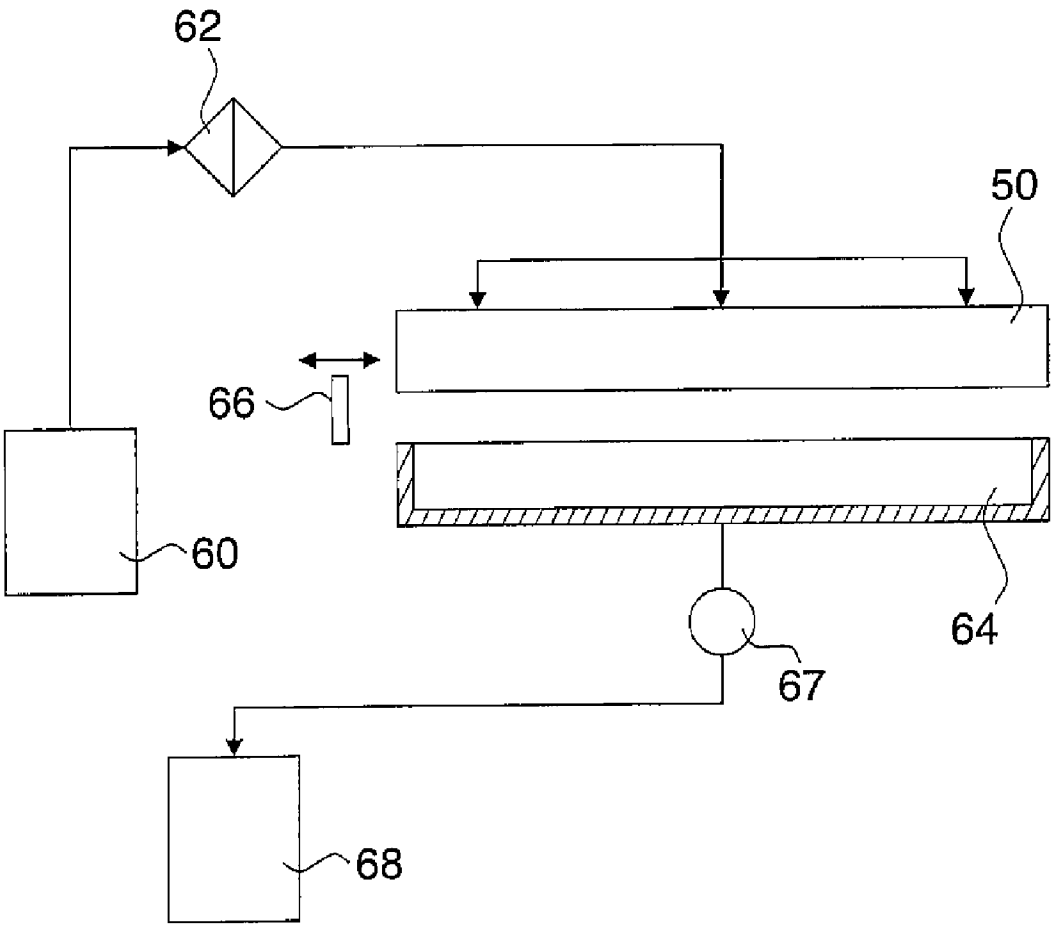
FIG. 7 is a general schematic drawing showing the composition of an ink supply system of the inkjet recording apparatus illustrated in FIG. 1.

FIG. 7 is a schematic drawing showing the configuration of an ink supply system in the inkjet recording apparatus 10.

The ink supply tank 60 is a base tank that supplies ink to the head 50 and is included in the ink storing and loading unit described with reference to FIG. 1. The aspects of the ink supply tank 60 include a refillable type in which the ink tank is filled with ink through a filling port (not shown) when the remaining amount of ink is low, and a cartridge type in which the ink tank is replaced with a new one. If the ink type is changed in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink supply tank 60 and the head 50 as illustrated in FIG. 7. The filter mesh size of the filter 62 is preferably equivalent to or less than the diameter of the nozzle and commonly about 20 μm.

Although not illustrated in FIG. 7, it is preferable to provide a sub-tank integrally to the head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the ink ejection face of the head 50.

A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power is turned OFF or when in a print standby state, the cap 64 is raised to a predetermined elevated position so as to come into close contact with the head 50, and the nozzle face is thereby covered with the cap 64.

During printing or standby, if the use frequency of a particular nozzle 51 is low, and if a state of not ejecting ink continues for a prescribed time period or more, then the solvent of the ink in the vicinity of the nozzle evaporates and the viscosity of the ink increases. In a situation of this kind, it might become impossible to eject ink from the nozzle 51, even if the piezoelectric element 58 is operated.

Therefore, before a situation of this kind develops (namely, while the ink is within a range of viscosity which allows it to be ejected by operation of the piezoelectric element 58), the piezoelectric element 58 is operated, and a preliminary ejection ("purge", "blank ejection", "liquid ejection" or "dummy ejection") is carried out toward the cap 64 (ink receptacle), in order to expel the degraded ink (namely, the ink in the vicinity of the nozzle which has increased viscosity).

It is also possible to adopt a mode in which preliminary ejection is performed by ejecting droplets of ink toward the intermediate transfer body 12. For example, if a plurality of images are formed in a continuous fashion, then it is possible to carry out preliminary ejection between the images. In particular, when a plurality of copies of the same image are formed, then the frequency of ejection of ink (treatment liquid) becomes low in particular nozzles, and there is an increased possibility that ejection abnormalities will occur; therefore, it is desirable to carry out preliminary ejection between images in respect of these particular nozzles.

If preliminary ejection is performed onto the intermediate transfer body 12, then the heating roller 26A is moved and a prescribed clearance (for example, approximately 10 mm) is provided between the heating roller 26A and the intermediate transfer body 12, in such a manner that the ink deposited by the preliminary ejection does not adhere to the heating roller 26A.

Furthermore, if air bubbles enter into the ink inside the head 50 (inside a pressure chamber 52), then even if the corresponding piezoelectric element 58 is operated, it might not be possible to eject ink from the nozzle. In a case of this kind, the cap 64 is placed on the head 50, the ink (ink containing air bubbles) inside the pressure chamber 52 is removed by suction, by means of a suction pump 67, and the ink removed by suction is then supplied to a recovery tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, desirably, preliminary ejection is carried out when the increase in the viscosity of the ink is still minor.

The cleaning blade 66 is composed of rubber or another elastic member, and can slide on the ink ejection surface of the head 50 by means of a blade movement mechanism (not illustrated). When ink droplets or foreign matter has adhered to the ink ejection face, the ink ejection face is wiped and cleaned by sliding the cleaning blade 66 on the nozzle plate.

If preliminary ejection is carried out between images, then by using the intermediate transfer body 12 as an ink receptacle, the time required for moving the cap 64 to a position directly below the print unit 20 (see FIG. 1) or the time required to withdraw the intermediate transfer body 12 from directly below the print unit 20 can be omitted, and therefore the time required for preliminary ejection can be shortened. Moreover, it is also possible to clean the ink adhering to the intermediate transfer body 12 due to preliminary ejection, by means of the cleaning treatment unit 28. If preliminary ejection is performed onto the intermediate transfer body 12, then the pressurization roller 26B should be separated from the intermediate transfer body 12 in order to prevent the pressurization roller 26B from becoming soiled with ink.

Description of the Control System

Figure 8:
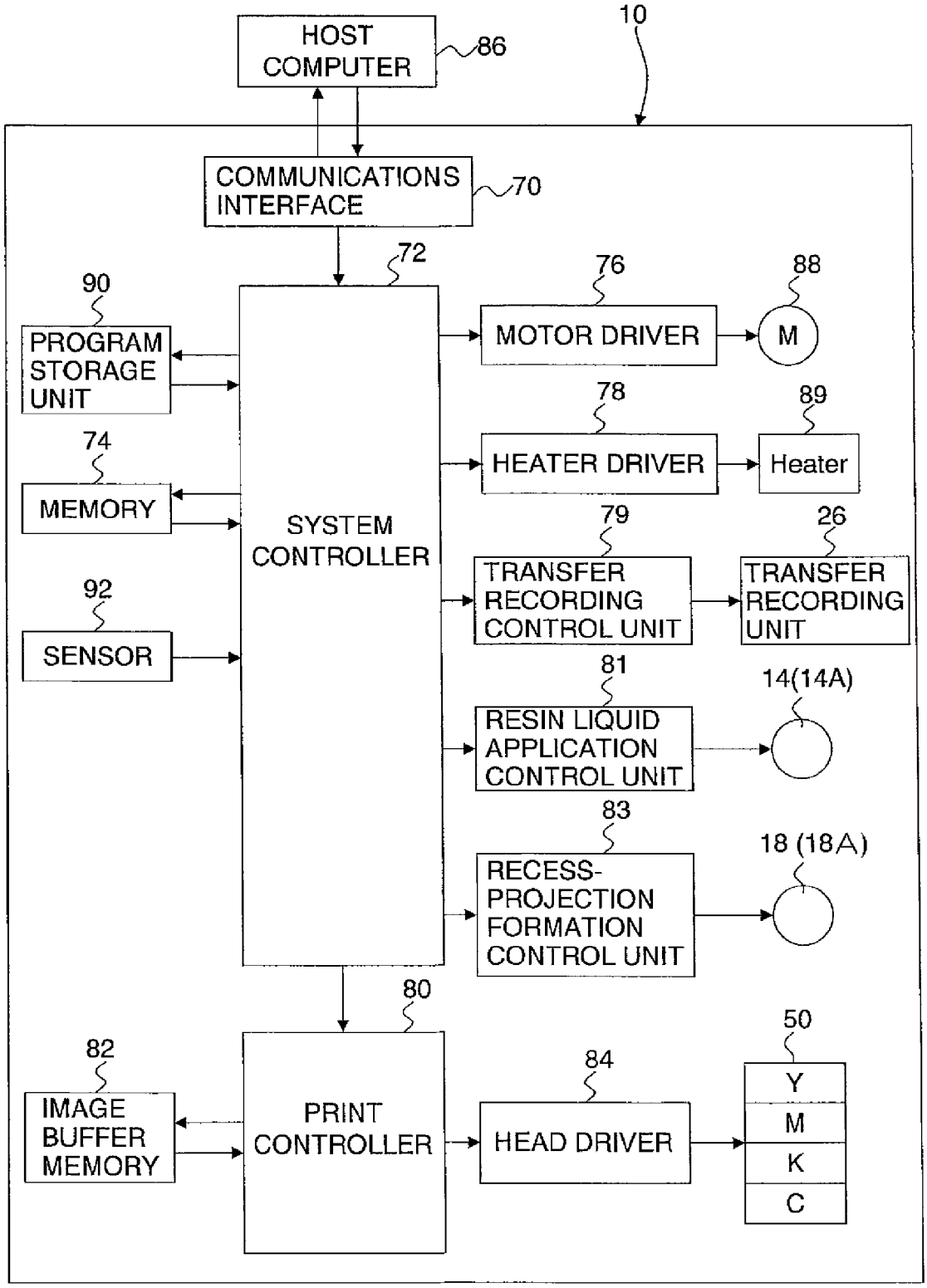
FIG. 8 is a general schematic drawing showing the composition of a control system of the inkjet recording apparatus illustrated in FIG. 1.

FIG. 8 is a principal block diagram showing a system configuration of the inkjet recording apparatus 10. The inkjet recording apparatus 10 comprises a communications interface 70, a system controller 72, a memory 74, a motor driver 76, a heater driver 78, a print controller 80, an image buffer memory 82, a head driver 84, and the like. Furthermore, as illustrated in FIG. 8, a transfer recording control unit 79, a resin liquid application control unit 81, a recess-projection formation control unit 83, and a sensor 92 are also provided.

The communications interface 70 is an interface unit for receiving image data sent from a host computer 86. A serial interface such as USB (Universal Serial Bus), IEEE1394, Ethernet (registered trademark), wireless network, or a parallel interface such as a Centronics interface may be used as the communications interface 70. A buffer memory (not shown) may be mounted in this portion in order to increase the communication speed. The image data sent from the host computer 86 is received by the inkjet recording apparatus 10 through the communications interface 70, and is temporarily stored in the memory 74.

The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with prescribed programs, as well as a calculation device for performing various calculations. More specifically, the system controller 72 controls the various sections, such as the communications interface 70, memory 74, motor driver 76, heater driver 78, and the like, as well as controlling communications with the host computer 86 and writing and reading to and from the memory 74, and it also generates control signals for controlling the heater 89 and the motor 88 of the conveyance system.

Programs executed by the CPU of the system controller 72 and the various types of data which are required for control procedures are stored in the memory 74. The memory 74 may be a non-writeable storage devices or it may be a rewriteable storage device, such as an EEPROM. The memory 74 is used as a temporary storage region for the image data, and it is also used as a program development region and a calculation work region for the CPU.

The motor driver 76 is a driver which drives the motor 88 in accordance with instructions from the system controller 72. In FIG. 8, the motors (actuators) disposed in the respective sections of the apparatus are represented by the reference numeral 88. The motor 88 illustrated in FIG. 8 includes, for example, a motor which drives the tensioning roller 30A in FIG. 1, a motor of the movement mechanism of the recess-projection roller 18A, a motor of the movement mechanism of the heating roller 26A, and so on.

The heater driver 78 is a driver which drives the heater 89 in accordance with instructions from the system controller 72. A plurality of heaters which are provided in the inkjet recording apparatus 10 are represented by the reference numeral 89 in FIG. 8. For instance, the heater 89 illustrated in FIG. 8 includes the heater of the drying treatment unit 16 illustrated in FIG. 1, and the like.

The transfer recording control unit 79 controls the pressing force of the pressurization roller 26B in the transfer recording unit 26 illustrated in FIG. 1. The optimal value for the pressing force of the heating rollers 26A and 26B is previously determined for each type of recording medium 24 and each type of ink, and this data is stored in a prescribed memory (for example, the memory 74) in the form of a data table. When information about the recording medium 24 or information about the ink used has been acquired, the pressing force of the pressurization roller 26B is controlled accordingly by referring to the memory.

Furthermore, the transfer recording control unit 79 controls the heating temperature of the heater which is incorporated into the heating roller 26A, in accordance with commands from the system controller 72. For example, if the type of recording medium 24 is selected (set) by means of a user interface (not illustrated), then the system controller 72 acquires the information about the recording medium 24, sets the optimal transfer temperature for that recording medium, and issues an instruction signal including the transfer temperature information, to the transfer recording control unit 79. The transfer recording control unit 79 controls the heating temperature of the heater which is incorporated into the heating roller 26A, in accordance with command signals from the system controller 72.

The print controller 80 has a signal processing function for performing various tasks, to compensations, and other types of processing for generating print control signals from the image data stored in the memory 74 in accordance with commands from the system controller 72 so as to supply the generated print data (dot data) to the head driver 84. Required signal processing is carried out in the print controller 80, and the ejection amount and the ejection timing of the ink droplets from the respective print heads 50 are controlled via the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80. Also possible is an aspect in which the print controller 80 and the system controller 72 are integrated to form a single processor.

The resin liquid application control unit 81 controls the pressing force of the application roller 14A and the application timing of the resin liquid in accordance with instructions from the system controller 72. For example, when the image forming region of the intermediate transfer body 12 illustrated in FIG. 1 arrives at the processing region of the resin liquid application unit 14, then the resin liquid application control unit 81 instructs the resin liquid application unit 14 to start the application of resin liquid, and when the image forming region has exited from the processing region of the resin liquid application unit 14, it instructs the resin liquid application unit 14 to halt the application of resin liquid.

The recess-projection formation control unit 83 controls the pressing force of the recess-projection roller 18A and the contact and separation between the recess-projection roller 18A and the intermediate transfer body 12 on the basis of instructions from the system controller 72. For example, when the image forming region on which the resin layer 40 has been formed reaches the working area of the recess-projection roller 18A, then the recess-projection formation control unit 83 sets the pressing force of the recess-projection roller 18A and also instructs the start of operation of the recess-projection roller 18A.

The head driver 84 generates drive signals to be applied to the piezoelectric elements 58 of the head 50, on the basis of image data supplied from the print controller 80, and also comprises drive circuits which drive the piezoelectric elements 58 by applying the drive signals to the piezoelectric elements 58. A feedback control system for maintaining constant drive conditions in the head 50 may be included in the head driver 84 illustrated in FIG. 8.

The image data to be printed is externally inputted through the communications interface 70, and is stored in the memory 74. In this stage, the RGB image data is stored in the memory 74.

The image data stored in the memory 74 is sent to the print controller 80 via the system controller 72, and is converted by the print controller 80 into dot data for the respective ink colors and dot data for the second treatment liquid. In other words, the print controller 80 performs processing for converting the inputted RGB image data into dot data for four colors, K, C, M and Y. The dot data generated by the print controller 80 is stored in the image buffer memory 82.

A primary image formed on the intermediate transfer body 12 must be a mirror image of the secondary image (recorded image) which is to be formed finally on the recording medium 24, taking account of the fact that it is reversed when transferred onto the recording medium. In other words, the drive signals supplied to the heads 50 are drive signals corresponding to the mirror image, and therefore the input image must be subjected to reversal processing by the print controller 80.

Various control programs are stored in a program storage section 90, and a control program is read out and executed in accordance with commands from the system controller 72. The program storage section 90 may use a semiconductor memory, such as a ROM, EEPROM, or a magnetic disk, or the like. An external interface may be provided, and a memory card or PC card may also be used. Naturally, a plurality of these storage media may also be provided. The program storage section 90 may also serve as a storage device for storing operational parameters, and the like (not shown).

In FIG. 8, various sensors (determination devices) provided in the apparatus are represented by the reference numeral 92. The sensors 92 include: temperature sensors which determine the temperatures of the respective units inside the apparatus, a position sensor which detects the intermediate transfer body 12 (the position of a primary image in the conveyance path), a sensor which determines the remaining amount of ink in the ink supply tank 60 illustrated in FIG. 7, a sensor which determines the surface characteristics of the intermediate transfer body 12 which are described hereinafter (indicated by reference numeral 102 in FIG. 11), and so on.

The determination signals from the sensors 92 illustrated in FIG. 8 are supplied to the system controller 72. Upon acquiring the determination signals sent by the sensors 92, the system controller 72 judges the various information provided by the determination signals and controls the respective units on the basis of this information.

EXAMPLES

Next, concrete examples of the image forming method shown in the present embodiment will be described. In the concrete examples, ink droplets were ejected under the same conditions onto a resin layer formed with a recess-projection shape (Ra=1.2 μm, cycle 5 μm) and a resin layer not formed with a recess-projection shape (Ra=0.2 μm), and the marking properties and transfer properties were evaluated. The surface roughness of the resin layer was measured by a Violet Laser VK-9500 device manufactured by Keyence Corporation.

FIG. 9A shows the composition of the resin liquid (undercoating liquid) used in the concrete examples. In the concrete examples, the resin liquid illustrated in FIG. 9A was applied so as to form a thickness of 5 μm, and the solvent was driven off by heating for 10 seconds at 70° C. Subsequently, a metal recess-projection roller was pressed against the resin layer at a pressing force of 2.0 MPa, thereby forming a recess-projection shape in the resin layer.

FIG. 9B shows the composition of the ink used in the concrete examples. In the concrete examples, a solid image and line images were formed at a resolution of 1200 dpi and a dot diameter of 30 μm onto the intermediate transfer body, using a pigment-based magenta ink. Thereupon, the image formed on the resin layer without a recess-projection shape was recorded by transfer to art paper manufactured by Mitsubishi Paper Mills Limited, under conditions of a transfer temperatures of 90° C. and a transfer pressure of 2.0 MPa, and furthermore, the image formed on the resin layer containing a recess-projection shape was recorded by transfer to special photographic paper at transfer temperatures of 90° C. and 50° C. and a transfer pressure of 2.0 MPa. The resulting marking properties and transfer properties were evaluated visually. FIG. 10A shows the experimental results for the marking properties in the concrete examples.

As illustrated in FIG. 10A, when no recess-projection shape was formed in the resin layer, then there was marked shrinkage of the solid image with respect to the desired droplet ejection region, and there was bending of the line (straight line) images. The shrinkage of the solid image was caused by positional displacement of the dots, and the bending of the line sections was also caused by positional displacement of the dots. In other words, when the resin layer is flat and smooth, then even if dots are deposited at desired positions, the dots subsequently slide in the horizontal direction and create dot movement (positional displacement), which can give rise to decline in the quality of the recorded image.

On the other hand, if recess-projection impressions corresponding to Ra=1.2 μm are formed in the resin layer, then it is possible to prevent the movement of the dots described above, and therefore a desired solid image was formed and desired line images were also formed. In other words, when a prescribed recess-projection shape is formed in the resin layer, then a satisfactory image is formed.

Furthermore, FIG. 10B shows the experimental results for the transfer properties. The transfer properties were evaluated respectively for transfer temperatures of 90° C. and 50° C., in a case where recess-projection impressions corresponding to Ra=1.2 μm were formed in the resin layer. When the transfer temperature was 90° C., the image was transferred and recorded satisfactorily. Furthermore, when the surface roughness of the resin layer after transfer at a transfer temperature of 90° C. (the portion of the resin layer where ink had not been deposited) was measured, the Ra value was Ra=0.5 μm. On the other hand, in the case of a transfer temperature of 50° C., some white spots occurred in a portion of the dots after transfer recording (namely, omissions in the dots where a portion of the ink forming the dots was not transferred), and therefore it was not possible to transfer and record a satisfactory image. When the surface roughness of a resin layer after transfer at a transfer temperature of 50° C. (the portion of the resin layer where ink had not been deposited) was measured, the Ra value was Ra=1.2 μm.

In other words, when the transfer temperature was 90° C., the resin layer was flattened by crushing the recess-projection impressions of the resin layer, and it was therefore possible to ensure a sufficiently large contact surface area between a primary image on the intermediate transfer body and the recording medium. On the other hand, if the transfer temperature was 50° C., then the recess-projection impressions in the resin layer were hardly crushed and they remained in place, and therefore a sufficient contact surface area between the primary image on the intermediate transfer body and the recording medium could not be ensured.

To summarize the evaluation results described above, it is possible to obtain a good image by setting the indentations (recess-projection) formed in the resin layer to Ra>0.5. Furthermore, if the transfer temperature exceeds 50° C., then good recording by transfer is achieved, and if the transfer temperature is equal to or greater than 90° C., then more desirable recording by transfer is achieved.

In the inkjet recording apparatus 10 having the composition described above, a resin layer having recess-projection impressions is formed on the image forming surface 12A of the intermediate transfer body 12 before the ejection of ink droplets. By ejecting droplets of ink onto the resin layer in which a recess-projection shape has been formed, positional displacement of the ink droplets (dots) on the intermediate transfer body 12 is prevented. Furthermore, since the primary image on the intermediate transfer body 12 is recorded by transfer onto the recording medium 24 in a state where a prescribed temperature and pressure are applied, then the recess-projection impressions in the resin layer are flattened due to the applied temperature and pressure, thereby making it possible to ensure a satisfactory contact surface area between the intermediate transfer body 12 and the recording medium 24, and hence desirable transfer and recording can be achieved even in cases where various types of recording media having different surface properties are used.

Moreover, since the resin layer is formed at each image recording operation and the resin layer is removed after transfer and recording, then there is no concern about variation in the surface properties with the passage of time.

The recess-projection impressions formed in the resin layer desirably have Ra>0.2 μm and more desirably, Ra≧1.2 μm. Moreover, the cycle of the recess-projection shape is desirably equal to or less than 5.0 μm and more desirably 0.1 μm. Furthermore, desirably the transfer temperature is greater than 50° C., and even more desirably, the transfer temperature is equal to or greater than 90° C., since this enables further flattening of the recess-projection impressions of the resin layer to a Ra value of approximately 0.5. The desirable transfer temperature must be set appropriately depending on the type of resin material.

Second Embodiment

Figure 11:
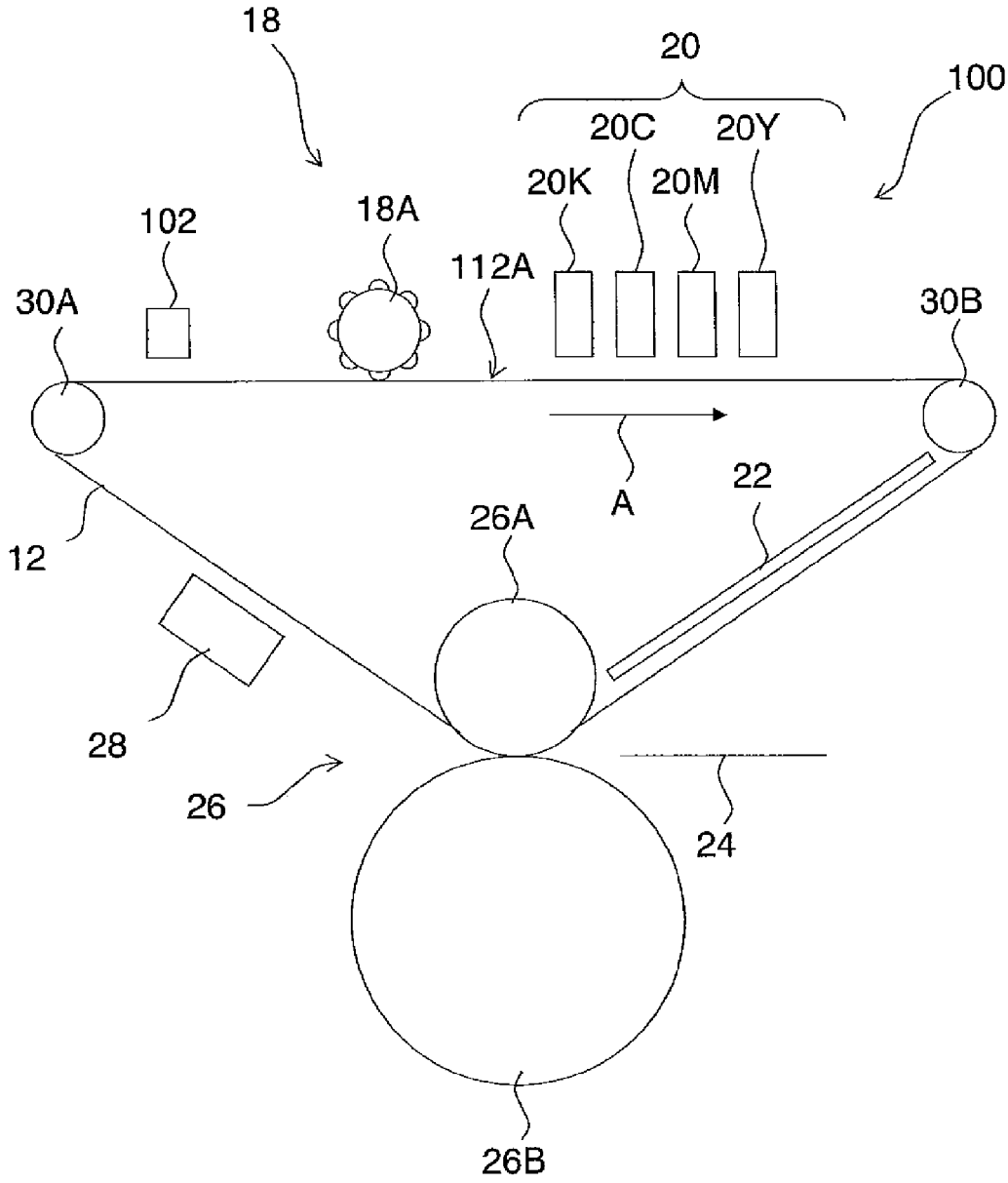
FIG. 11 is a general schematic drawing of an inkjet recording apparatus relating to a second embodiment of the present invention.

Next, a second embodiment of the present invention will be described. FIG. 11 shows the general composition of an inkjet recording apparatus 100 relating to the second embodiment of the present invention. In FIG. 11, parts which are the same as or similar to those illustrated in FIG. 1 are labeled with the same reference numerals and further explanation thereof is omitted here.

In the inkjet recording apparatus 100 illustrated in FIG. 11, a rubber layer (not illustrated in FIG. 11 and indicated by reference numerals 140 and 140' in FIGS. 12A to 12D) is provided in the surface of an intermediate transfer body 112 (image forming surface 12A) and a recess-projection shape is formed directly in that rubber layer by means of the recess-projection forming unit 18. As a method of forming the recess-projection shape in the rubber layer, similarly to the inkjet recording apparatus 10 in FIG. 1, a method is employed in which a recess-projection roller 15A having recess-projection impressions formed in the surface thereof is passed over the rubber layer, thereby transferring the recess-projection impressions of the recess-projection roller 18A to the rubber layer. In the inkjet recording apparatus 100 according to the present embodiment, the resin liquid application unit 14 of the inkjet recording apparatus 10 illustrated in FIG. 1 is omitted.

It is possible to use silicone rubber or various types of rubber material for the rubber layer of the present embodiment. In order to restrict wear of the rubber layer, the pressure imparted to the rubber layer should be made as small as possible, and therefore a rubber material having small hardness should be used as the material of the rubber layer. Desirably, the rubber material used for the rubber layer according to the present embodiment has a hardness of 50 degrees or less, and more desirably, a hardness of 30 degrees or less.

Furthermore, in order to obtain satisfactory transfer properties, a rubber material having low surface energy should be used. The surface energy of the rubber layer employed in the present embodiment is in the range of 15 mN/m or greater and 30 mN/m or lower. If a rubber material having a low surface energy is used for the rubber layer, then "beading (liquid repellency)" of the ink droplets deposited onto the intermediate transfer body may occur. In cases such as these, it is possible to lower the surface energy of the ink or to adopt a composition in which ink droplets are deposited after applying a surfactant which dissolves in the ink, to the rubber layer.

In the present embodiment, a mode is described in which a rubber layer is provided in the image forming surface 112A of the intermediate transfer body 112, but it is also possible to adopt a resin layer instead of the rubber layer. If a resin layer is used instead of the rubber layer, then it is desirable to employ a resin which is stable with respect to the thermal history (a resin which does not change the properties even if it passes through a plurality of heating and cooling processes).

Figure 12A:
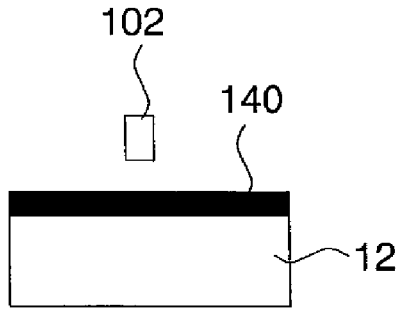
FIGS. 12A to 12D are diagrams showing an image forming method relating to the second embodiment of the present invention.

In the inkjet recording apparatus 100 according to the present embodiment, since the rubber layer is used repeatedly, then a sensor 102 which determines the surface state of the rubber layer is provided to the upstream side of the recess-projection forming unit 18 in terms of the direction of movement of the intermediate transfer body, and a composition is adopted in which the surface state of the rubber layer before forming recess-projection impressions (and in a state where the recess-projection impressions are crushed after the transfer and recording process) is determined, and the parameters such as the pressure of the recess-projection forming roller and the temperature of the rubber layer (intermediate transfer body) during formation of the recess-projection impressions can be varied on the basis of the determination results. FIG. 12A shows a schematic drawing of a surface state determination step of determining the surface state of the rubber layer 140 by means of the sensor 102.

The sensor 102 may use a simple method, such as a non-contact system which radiates laser light or the like onto the rubber layer 140 and acquires the reflected light by means of a photoreceptor element, or a contact system which runs extremely fine terminals over the rubber layer in contact with same.

For example, a reference range for the surface roughness of the rubber layer is established in advance, and if the determined surface roughness exceeds this reference range, then the pressing force of the recess-projection roller 18A is set to be lower than the reference value, whereas if the determined surface roughness is lower than the reference range, then the pressing force of the recess-projection roller 18A is set to be higher than the reference value. Furthermore, if the determined surface roughness exceeds the reference range, then the heating temperature of the heater (not illustrated) is set to be lower than the reference value, and if the determined surface roughness is lower than the reference range, then the beating temperature of the heater is set to be higher than the reference value. The pressing force of the recess-projection roller 18A of this kind is controlled by the system controller 72 in FIG. 8.

In a mode where the rubber layer (intermediate transfer body 112) is heated during formation of the recess-projection shape, the heater used for heating may either be built into the intermediate transfer body 112 or it may be disposed on the opposite side of the intermediate transfer body 112 from the recess-projection forming unit 18.

Furthermore, a mode is also possible in which a plurality of recess-projection forming rollers having different recess-projection cycles and different recess-projection amplitudes are provided, the recess-projection forming roller being switched in accordance with the determination results of the sensor 102.

For example, three types of recess-projection forming roller are provided, namely, a roller having recess-projection impressions of 5 μm amplitude (standard roller), a roller having recess-projection impressions of 1 μm amplitude (small roller), and a roller having recess-projection impressions of 10 μm amplitude (large roller). If the determined surface roughness is within the reference range, then the standard roller is used, and if the determined surface roughness exceeds the reference range then the small roller is used. Furthermore, if the determined surface roughness is less than the reference range, then the large roller is used. In this way, it is possible to form a uniform recess-projection shape regardless of the surface is roughness of the rubber layer after the transfer recording operation. In other words, the recess-projection shape formed by the recess-projection forming unit 18 is controlled in accordance with the determined surface roughness of the rubber layer, in such a manner that the surface roughness of the rubber layer at the time of the ejection of ink droplets is a uniform surface roughness at all times.

Figure 12B:
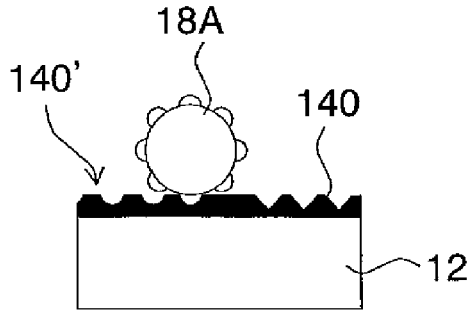
Figure 12C:
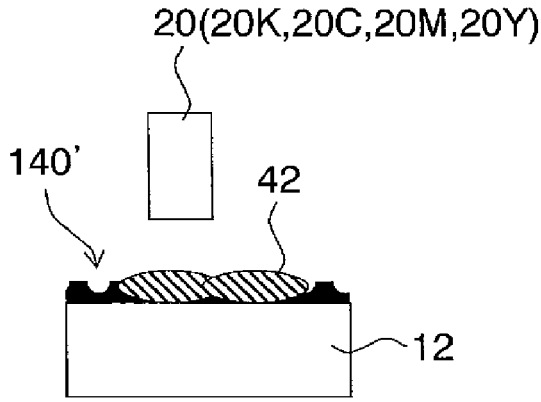

FIG. 12B shows a resin layer 140' obtained by reprocessing the rubber layer 140 by the recess-projection roller 18A in accordance with the surface roughness. When the recess-projection forming step illustrated in FIG. 12B has been completed, ink droplets 42 of respective colors are ejected from the print unit 20 onto the rubber layer 140' which has undergone the recess-projection formation processing, thereby forming a primary image on the intermediate transfer body 12 (see FIG. 12C).

Figure 12D:
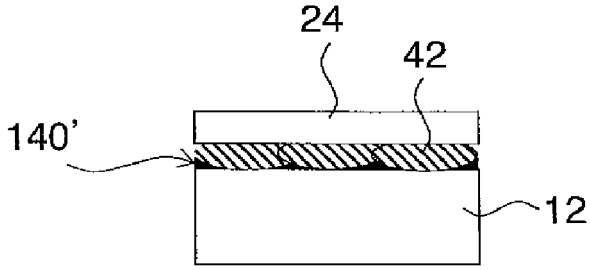

When a primary image has been formed on the intermediate transfer body 12, heat and pressure are applied in a state where the recording medium 24 is in contact with the intermediate transfer body 112, as illustrated in FIG. 12D. Since the primary image on the intermediate transfer body 112 is transferred and recorded onto the recording medium 24 in a state where the recess-projection impressions of the rubber layer 140' have been crushed due to the heat and pressure applied in the transfer recording step, then it is possible to ensure sufficient contact surface area between the intermediate transfer body 112 and the recording medium 24, during the transfer recording operation, and therefore satisfactory transfer recording can be achieved.

In the second embodiment described above, the heating temperature during the formation of recess-projection impressions is set to the range of equal to or greater than 50° C. and equal to or less than 150° C., and the nip pressure is set to the range of equal to or greater than 0.5 MPa and equal to or less than 3.0 MPa. Moreover, the heating temperature during the transfer recording operation is set to the range of equal to or greater than 50° C. and equal to or less than 150° C., and the nip pressure is set to the range of equal to or greater than 0.5 MPa and equal to or less than 3.0 MPa.

According to the second embodiment of the present invention, it is possible to use the rubber layer provided in the surface of the intermediate transfer body repeatedly, by reprocessing the recess-projection shape, and therefore it is not necessary to form the resin layer each time an image is recorded. Furthermore, since only the residual ink on the rubber layer needs to be removed during the cleaning process, then the load involved in the cleaning process is reduced compared to a case where the resin layer is removed.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus which forms a primary image on an intermediate transfer body and then transfers the primary image onto a recording medium, the image forming apparatus comprising:

a movement device which moves the intermediate transfer body in a movement direction;

a recess-projection forming device which forms a recess-projection shape in an image forming surface of the intermediate transfer body;

a droplet ejection device which is provided on a downstream side of the recess-projection forming device in terms of the movement direction and ejects droplets of ink onto the image forming surface of the intermediate transfer body in which the recess-projection shape has been formed, to form the primary image;

a transfer recording device which is provided on a downstream side of the droplet ejection device in terms of the movement direction and applies pressure to at least one of the intermediate transfer body and the recording medium in a state where the recording medium makes contact with the primary image formed on the image forming surface of the intermediate transfer body to transfer the primary image onto the recording medium, and an application device which is provided on an upstream side of the recess-projection forming device in terms of the movement direction and applies resin material onto a whole of the image forming surface of the intermediate transfer body, wherein the recess-projection forming device includes a pressing member with a surface having a recess-projection shape corresponding to the recess-projection shape to be formed in the image forming surface of the intermediate transfer body, the pressing member being pressed against the resin material on the intermediate transfer body to form the recess-projection shape in the image forming surface of the intermediate transfer body.

2. The image forming apparatus as defined in claim 1, further comprising a resin material heating device which heats the resin material on the image forming surface of the intermediate transfer body, wherein:

the resin material to be applied onto the image foaming surface of the intermediate transfer body by the application device contains a thermoplastic resin material; and the resin material heating device heats the resin material in such a manner that the thermoplastic resin material assumes a softened state while the recess-projection forming device forms the recess-projection shape.

3. The image forming apparatus as defined in claim 2, wherein the resin material heating device is provided between the application device and the recess-projection forming device.

4. The image forming apparatus as defined in claim 2, wherein the resin material heating device is provided at a position across the intermediate transfer body from the recess-projection forming device to correspond to a position of the recess-projection forming device.

5. The image forming apparatus as defined in claim 2, wherein the resin material heating device is incorporated into the intermediate transfer body.

6. The image forming apparatus as defined in claim 1, further comprising a treatment liquid application device which applies a treatment liquid which enhances aggregation of the ink or increases in viscosity of the ink, onto the image forming surface of the intermediate transfer body.

7. The image forming apparatus as defined in claim 6, wherein the application device also serves as the treatment liquid application device, and applies the treatment liquid and the resin material onto the image forming surface of the intermediate transfer body.

8. The image forming apparatus as defined in claim 1, comprising a transfer heating device that is provided on a downstream side of the droplet ejection device in terms of the movement direction and heats the intermediate transfer body on which the primary image has been formed, wherein the transfer recording device transfers the primary image formed on the intermediate transfer body onto the recording medium, and flattens the recess-projection shape.

9. The image forming apparatus as defined in claim 1, wherein a cycle of the recess-projection shape in the image forming surface is not less than four times and not more than ten times resolution of the primary image.

10. The image forming apparatus as defined in claim 1, wherein a cycle of the recess-projection shape in the image forming surface is not less than 1/15 and not more than 1/6 of a diameter of each of dots formed by the droplets of the ink.

11. The image forming apparatus as defined in claim 1, wherein amplitude of the recess-projection shape in the image forming surface is Ra>0.2 μm.

12. The image forming apparatus as defined in claim 1, wherein amplitude of the recess-projection shape in the image forming surface is Ra>1.2 μm.

13. The image forming apparatus as defined in claim 1, wherein the recess-projection shape in the image forming surface has a cross-sectional shape of a semi-circle or a triangle.

14. An image forming apparatus which forms a primary image on an intermediate transfer body and then transfers the primary image onto a recording medium, the image forming apparatus comprising:

a movement device which moves the intermediate transfer body in a movement direction;

a recess-projection forming device which forms a recess-projection shape in an image forming surface of the intermediate transfer body;

a droplet ejection device which is provided on a downstream side of the recess-projection forming device in terms of the movement direction and ejects droplets of ink onto the image forming surface of the intermediate transfer body in which the recess-projection shape has been formed, to form the primary image;

a transfer recording device which is provided on a downstream side of the droplet ejection device in tell is of the movement direction and applies pressure to at least one of the intermediate transfer body and the recording medium in a state where the recording medium makes contact with the primary image foamed on the image forming surface of the intermediate transfer body to transfer the primary image onto the recording medium, wherein:

the intermediate transfer body has, in a whole of the image forming surface, a surface layer in which the recess-projection forming device forms the recess-projection shape; and the recess-projection forming device includes a pressing member with a surface having a recess-projection shape corresponding to the recess-projection shape to be formed in the image forming surface of the intermediate transfer body, the pressing member being pressed against the surface layer of the intermediate transfer body to form the recess-projection shape in the image forming surface of the intermediate transfer body.

15. The image forming apparatus as defined in claim 14, further comprising a surface layer heating device which heats the surface layer of the image forming surface of the intermediate transfer body while the recess-projection forming device forms the recess-projection shape in the image forming surface.

16. The image forming apparatus as defined in claim 14, further comprising:

a determination device which determines a state of the surface layer of the image forming surface of the intermediate transfer body; and a transfer heating device that is provided on a downstream side of the droplet ejection device in terms of the movement direction and heats the intermediate transfer body on which the primary image has been formed, wherein the recess-projection forming device forms the recess-projection shape in the image forming surface in such a manner that, if an amount of recess-projection of the surface layer determined by the determination device is greater than a reference amount of recess-projection, then the pressing member is pressed against the surface layer with a pressure smaller than a reference value or the transfer heating device less heats the intermediate transfer body than a reference value.

17. The image foil ling apparatus as defined in claim 14, further comprising a determination device which determines a state of the surface layer of the image forming surface of the intermediate transfer body, wherein:

the recess-projection forming device has a plurality of recess-projection forming members which are formed with recess-projection impressions of different shapes; and the recess-projection forming device switches selectively among the plurality of recess-projection forming members in accordance with an amount of recess-projection of the surface layer determined by the determination device.

18. The image forming apparatus as defined in claim 14, further comprising a treatment liquid application device applying a treatment liquid which reacts with the ink to enhance aggregation of the ink or increase in viscosity of the ink, onto the image forming surface of the intermediate transfer body.

19. The image forming apparatus as defined in claim 14, comprising a transfer heating device that is provided on a downstream side of the droplet ejection device in terms of the movement direction and heats the intermediate transfer body on which the primary image has been formed, wherein the transfer recording device transfers the primary image formed on the intermediate transfer body onto the recording medium, and flattens the recess-projection shape.

20. The image forming apparatus as defined in claim 14, wherein a cycle of the recess-projection shape in the image forming surface is not less than four times and not more than ten times resolution of the primary image.

21. The image foil ling apparatus as defined in claim 14, wherein a cycle of the recess-projection shape in the image forming surface is not less than 1/15 and not more than 1/6 of a diameter of each of dots formed by the droplets of the ink.

22. The image forming apparatus as defined in claim 14, wherein amplitude of the recess-projection shape in the image forming surface is Ra>0.2 μm.

23. The image forming apparatus as defined in claim 14, wherein amplitude of the recess-projection shape in the image forming surface is Ra>1.2 μm.

24. The image forming apparatus as defined in claim 14, wherein the recess-projection shape in the image forming surface has a cross-sectional shape of a semi-circle or a triangle.

25. An image forming method of forming a primary image on an intermediate transfer body and then transferring the primary image onto a recording medium, the image forming method comprising:

a movement step of moving the intermediate transfer body in a movement direction;

a recess-projection forming step of forming a recess-projection shape in an image forming surface of the intermediate transfer body;

a droplet ejection step of ejecting droplets of ink onto the image forming surface of the intermediate transfer body in which the recess-projection shape has been formed in the recess-projection forming step, to form the primary image on the intermediate transfer body;

a transfer recording step of applying pressure to at least one of the intermediate transfer body and the recording medium in a state where the recording medium makes contact with the primary image formed on the image forming surface of the intermediate transfer body after the droplet ejection step, to transfer the primary image onto the recording medium; and an application step which is provided on an upstream side of the recess-projection forming step in terms of the movement direction and applies resin material onto a whole of the image foil ling surface of the intermediate transfer body, wherein the recess-projection forming step includes a pressing member with a surface having a recess-projection shape corresponding to the recess-projection shape to be formed in the image forming surface of the intermediate transfer body, the pressing member being pressed against the resin material on the intermediate transfer body to form the recess-projection shape in the image forming surface of the intermediate transfer body.

26. An image forming method of forming a primary image on an intermediate transfer body and then transferring the primary image onto a recording medium, the image forming method comprising:

a movement step of moving the intermediate transfer body in a movement direction;

a recess-projection forming step of forming a recess-projection shape in an image forming surface of the intermediate transfer body;

a droplet ejection step of ejecting droplets of ink onto the image foaming surface of the intermediate transfer body in which the recess-projection shape has been formed in the recess projection forming step, to form the primary image on the intermediate transfer body; and a transfer recording step of applying pressure to at least one of the intermediate transfer body and the recording medium in a state where the recording medium makes contact with the primary image formed on the image forming surface of the intermediate transfer body after the droplet ejection step, to transfer the primary image onto the recording medium, wherein:

the intermediate transfer body has, in a whole of the image forming surface, a surface layer in which the recess-projection forming step forms the recess-projection shape; and the recess-projection forming step includes a pressing member with a surface having a recess-projection shape corresponding to the recess-projection shape to be formed in the image forming surface of the intermediate transfer body, the pressing member being pressed against the surface layer of the intermediate transfer body to form the recess-projection shape in the image forming surface of the intermediate transfer body.

* * * * *